US009072387B2

(12) United States Patent
Lobry et al.

(10) Patent No.: US 9,072,387 B2
(45) Date of Patent: Jul. 7, 2015

(54) SUSPENSION DEVICE FOR A BED BASE WITH ADJUSTABLE STIFFNESS

(71) Applicant: TOURNADRE SA STANDARD GUM, Bourges (FR)

(72) Inventors: Jacques Lobry, Bourges (FR); Pascal Lobry, Bourges (FR); Géraud Cailley, Bourges (FR)

(73) Assignee: TOURNADRE SA STANDARD GUM, Bourges (FR)

( * ) Notice: Subject to any disclaimer, the term of this patent is extended or adjusted under 35 U.S.C. 154(b) by 12 days.

(21) Appl. No.: 13/899,687

(22) Filed: May 22, 2013

(65) Prior Publication Data

US 2013/0334746 A1 Dec. 19, 2013

(30) Foreign Application Priority Data

May 23, 2012 (EP) ..... 12169155
Nov. 28, 2012 (FR) ..... 12 61372

(51) Int. Cl.
*A47C 23/06* (2006.01)
*A47C 17/86* (2006.01)
*A47C 7/35* (2006.01)

(52) U.S. Cl.
CPC ..... *A47C 17/86* (2013.01); *A47C 23/067* (2013.01); *A47C 23/068* (2013.01); *A47C 7/35* (2013.01)

(58) Field of Classification Search
USPC ..... 267/97, 99, 101, 103–105; 5/236.1, 5/238, 141
See application file for complete search history.

(56) References Cited

U.S. PATENT DOCUMENTS

| | | | | |
|---|---|---|---|---|
| 4,222,134 | A * | 9/1980 | Degen | 5/191 |
| 4,752,981 | A * | 6/1988 | Salens | 5/238 |
| 6,877,174 | B2 * | 4/2005 | Lobry | 5/238 |
| 7,069,606 | B2 * | 7/2006 | Verschuere et al. | 5/236.1 |
| 8,745,783 | B2 * | 6/2014 | Jansen | 5/236.1 |

FOREIGN PATENT DOCUMENTS

| | | | |
|---|---|---|---|
| DE | 202004016392 | U1 | 2/2005 |
| DE | 202005006530 | U1 | 8/2005 |
| EP | 1364600 | A1 | 11/2003 |
| FR | 2945195 | A1 | 11/2010 |

* cited by examiner

*Primary Examiner* — Christopher Schwartz
(74) *Attorney, Agent, or Firm* — MH2 Technology Law Group, LLP

(57) ABSTRACT

A suspension device (510') for a bed base or a seat, comprising an upper section fitted with a top plate capable of supporting a mattress, a lower section (520') adapted to be attached to a bed base, said lower section being connected to the upper section by a suspension means, a mobile element (540'), which is movable relative to the suspension device so that said mobile element can be shifted at least between a first position and a second position for modifying a stiffness of the suspension device.
The mobile element (540') is fitted with at least one first elastic body which is configured to deform elastically when the mobile element is brought from one position to the other.

18 Claims, 21 Drawing Sheets

SUSPENSION DEVICE FOR A BED BASE WITH ADJUSTABLE STIFFNESS

BACKGROUND OF THE INVENTION

The present invention relates to the field of elastic suspension of bed bases and seats pour sofas or armchairs. It relates especially, though not exclusively, to the elastic suspension of slats of a slat bed base.

It relates more particularly to a suspension device for a bed base or a seat, comprising:

- an upper section fitted with a top plate capable of supporting a mattress;
- a lower section comprising means for fixing the suspension device to the bed base or to the seat, said lower section being connected to the upper section by suspension means;
- means for modifying the stiffness of the suspension device.

Such a suspension device is especially described in document FR 2 945 195. In this document, the means for modifying the stiffness of the suspension device comprise a rigid stiffening element which lodges between either of the lower and upper sections and a spring element of the suspension device. The resulting connecting leads to increasing the stiffness of the spring element, and therefore that of the suspension device.

A drawback to this suspension device is that the presence of the stiffening element substantially decreases the deformation range of the suspension device. Substantial force is therefore necessary to deform the suspension device, which is likely to harm the impression of comfort given by the suspension device.

AIM AND SUMMARY OF THE INVENTION

An aim of the present invention is to propose a bed base suspension device with adjustable stiffness which has an improved comfort curve.

In some embodiments of the present invention the suspension device is a suspension device for a bed base or a seat, comprising:

- an upper section fitted with a top plate capable of supporting a mattress;
- a lower section comprising means for fixing the suspension device to the bed base, said lower section being connected to the upper section by suspension means;
- means for modifying the stiffness of the suspension device comprising a mobile element fitted with at least one first elastic body.

In this way, the mobile element is elastically deformable so as to participate actively in modulating the stiffness of the suspension device.

In some embodiments, the mobile element can have a first position in which the mobile element has a first stiffness when pressure is applied to the suspension device, so as to produce elastic coupling between the upper and lower sections with said first stiffness.

In particular, in the first position when pressure is applied to the suspension device the first elastic body can adopt a first configuration capable of deforming elastically to exert retraction force with a first stiffness R1. In this way, in this first position the first elastic body can exhibit this first stiffness R1 when pressure is applied to the suspension device and create elastic coupling between the upper and lower sections with said first stiffness R1.

In some embodiments, the mobile element can have another position, so-called "second position" which is separate from the first position and in which the mobile element is not capable of creating said elastic coupling between the upper and lower sections with said first stiffness when pressure is applied to the suspension device.

In particular, in the second position when pressure is applied to the suspension device, the first elastic body can be such that it is not capable of exerting said retraction force with said first stiffness R1 and is not capable of creating said elastic coupling between the upper and lower sections with said first stiffness R1.

In some embodiments, the suspension means can exhibit so-called "suspension" stiffness Rs when pressure is applied to the suspension device, and the suspension means and the mobile element can be configured so that said suspension stiffness Rs does not vary when the mobile element is brought from one position to another (in particular when the mobile element is shifted between the first position and the second position).

In particular, the value of the suspension stiffness Rs can be independent of the position occupied by the mobile element relative to the suspension device.

In some embodiments, the suspension means can be capable of deforming elastically with displacement capacity (displacement or deformation scale) which does not vary when the mobile element is brought from one position to another (in particular when the mobile element is shifted between the first position and the second position).

In this way, the suspension means can adopt a so-called "suspension" configuration which, to exert retraction force with the abovementioned suspension stiffness Rs, is capable of deforming elastically with predetermined displacement capacity when pressure is applied to the suspension device; and the suspension means and the mobile element can be configured so that said suspension configuration remains unchanged when the mobile element is brought from one position to another.

In particular, said displacement capacity can be independent of the position occupied by the mobile element relative to the suspension device.

In some embodiments, the device can be such that when pressure is applied to the suspension device while the mobile element adopts its first position, the upper section and the lower section shift relative to each other over a predetermined displacement path, and the suspension means and the first elastic body are compressed and deform elastically simultaneously on at least one part of said displacement path.

In this way, the suspension means and the first elastic body of the mobile element in its first position can be connected in parallel on at least this part of said displacement path when pressure is applied to the suspension device. The suspension stiffness Rs and the first stiffness R1 can be connected in parallel on at least this part of said displacement path.

In particular, these degrees of stiffness Rs and R1 can be added mutually to at least this part of said displacement path when pressure is applied to the suspension device while the mobile element occupies its first position.

In some embodiments, the suspension means can exhibit the suspension stiffness Rs when pressure is applied to the suspension device, so as to create elastic coupling principal between the upper and lower sections with said stiffness Rs, while the first elastic body can exhibit the first stiffness R1 when this pressure is applied to the suspension device while the mobile element occupies its first position, so as to create secondary (extra) elastic coupling between the upper and lower sections with said first stiffness R1.

In particular, these principal and secondary elastic connections can be made separately from each other and be added mutually to at least part of the abovementioned displacement path when pressure is applied to the suspension device while the mobile element occupies its first position.

In some embodiments, the first elastic body of the mobile element in its first position can be compressed and deform elastically only after slight displacement of the upper section and of the lower section relative to each other when pressure is applied to the suspension device. In particular, the elastic coupling between the upper and lower sections with the first stiffness, which results from compression and elastic deformation of the first elastic body when pressure is applied to the suspension device while the mobile element adopts its first position, can be effectively created only after this slight displacement of the upper section and of the lower section relative to each other.

In some embodiments, the suspension device can be such that, in the second position the first elastic body has a second stiffness, different from the first stiffness when pressure is applied to the suspension device so as to create elastic coupling between the upper and lower sections with said second stiffness.

In this way, in this second position when pressure is applied to the suspension device, the first elastic body can adopt a second configuration, separate from the first configuration, capable of deforming elastically to exert retraction force with a second stiffness R2, different from the first stiffness R1, and creating elastic coupling between the upper and lower sections with said second stiffness R2.

Therefore when the mobile element is brought to its second position from its first position, the first elastic body is no longer capable of exerting retraction force with the first stiffness R1 and is no longer capable of creating elastic coupling between the upper and lower sections with said first stiffness R1. On the contrary, the first elastic body becomes capable of exerting retraction force with the second stiffness R2 and capable of creating elastic coupling between the upper and lower sections with said second stiffness R2.

In particular, two different degrees of stiffness R1 and R2 can be advantageously obtained with a single first elastic body, simply by arranging this first elastic body differently relative to the suspension device, by the displacement clearance of the mobile element between its first position and its second position.

In some embodiments, the first elastic body can be configured to deform elastically when the mobile element is brought from one position to the other.

It is understood that in some embodiments the suspension device for bed base or seat can be such that it comprises:

- an upper section fitted with a top plate capable of supporting a mattress;
- a lower section comprising means for fixing the suspension device to the bed base, said lower section being connected to the upper section by suspension means;
- means for modifying the stiffness of the suspension device, comprising a mobile element relative to the suspension device so it can be shifted at least between a first position and a second position for modifying the stiffness of the suspension device. This mobile element can be fitted with at least one first elastic body which is configured to deform elastically when the mobile element is brought from one position to the other.

In particular, the first elastic body can adopt a first configuration when the mobile element adopts its first position, and a second configuration, separate from the first when the mobile element adopts its second position. Moving from one configuration to the other can be done by elastic deformation of the first elastic body which is caused by displacement of the mobile element from one position to the other. In addition, since this elastic deformation results from displacement of the mobile element from one position to the other, this elastic deformation can occur while the suspension means remain at rest (i.e. without having to apply pressure to the suspension device aiming at bringing together the upper and lower sections relative to each other).

In some embodiments, the first configuration can be such that in the first position the first elastic body has a first stiffness when pressure is applied to the suspension device to create elastic coupling between the upper and lower sections with said first stiffness.

In some embodiments, the first configuration can be such that in the first position the first elastic body is forced into a first state of elastic deformation, which allows the first elastic body when pressure is applied to the suspension device to exhibit the first stiffness. Such a first state of deformation can exist in the absence of any pressure applied to the device by an operator and be amplified when such pressure is applied.

In some embodiments, the mobile body can be configured such that the first configuration is a first compression configuration of the first elastic body according to the direction of approach of the upper and lower sections relative to each other.

In some embodiments, the second configuration can be such that in the second position the first elastic body exhibits a second stiffness when pressure is applied to the suspension device to create elastic coupling between the upper and lower sections with said second stiffness.

In some embodiments, the second configuration can be such that in the second position the first elastic body is forced into a second state of elastic deformation, which allows the first elastic body when pressure is applied to the suspension device to exhibit the second stiffness. Such a second state of deformation can exist in the absence of any pressure applied to the device by an operator and be amplified when such pressure is applied.

In some embodiments, the mobile body can be configured such that the second configuration is a second compression configuration of the first elastic body according to the direction of approach of the upper and lower sections relative to each other.

In some embodiments, moving from one configuration to the other can be done by buckling (squashing) of the first elastic body caused by the mobile element moving from one position to the other.

In some embodiments, the mobile element can comprise a basic body mounted mobile on the suspension device; and an elastic tab, as first elastic body, which has a first end by which this tab is attached to said basic body, and a second end which is free to move away from and move close to the basic body by flexion of the first end (which acts as point of flexion for the tab) and which is configured to cooperate with the suspension device such that the tab creates elastic coupling between the upper and lower sections when pressure is applied to the suspension device. In these modes when the mobile element is shifted between its first position and its second position the position of the first end of the tab is shifted to vary the flexion capacity of the tab relative to the basic body and, therefore, to vary between its values R1 and R2 the stiffness of the retraction force opposed by the tab to the relative displacement of the upper section relative to the lower section when pressure is applied to the suspension device.

In some embodiments, the first elastic body can be capable of adopting a first flexion configuration when the mobile element occupies its first position, and a second flexion configuration (different from the first one) when the mobile element occupies its second position, so as to vary the resistance opposed by the first elastic body to its flexion and, therefore, to vary between its values R1 and R2 the stiffness of the retraction force opposed by the first elastic body to the relative displacement of the upper section relative to the lower section when pressure is applied to the suspension device.

In some embodiments, the mobile element can comprise a flexible blade, as first elastic body, capable of being arranged between the lower and upper sections, respectively in the first flexion configuration when the mobile element occupies its first position, and in the second flexion configuration (different from the first) when the mobile element occupies its second position, so as to vary the resistance opposed by the flexible blade to its flexion and, therefore, to vary between its values R1 and R2 the stiffness of the retraction force opposed by this blade to the relative displacement of the upper section relative to the lower section when pressure is applied to the suspension device.

In some embodiments, the first elastic body can be configured to deform elastically at least in a transverse plane parallel to the spacing direction of the upper and lower sections relative to each other when the mobile element is brought from one position to the other.

In some embodiments, this spacing direction can correspond to a direction perpendicular to the top plate of the upper section, such that the transverse plane can correspond to a plane perpendicular to this top plate.

In some embodiments, the suspension device can comprise a plane of symmetry and be configured such that the transverse plane is by choice parallel or perpendicular to the plane of symmetry.

In some embodiments, the suspension device can be such that the upper section comprises at least one housing (for example two housings) to take up the end of a slat according to a direction of insertion.

In some embodiments, the suspension device can be such that the transverse plane is by choice parallel or perpendicular to this direction of insertion.

In some embodiments, the suspension device can be such that the suspension means comprise at least two suspension elements spaced according to a longitudinal direction of the device, and the transverse plane can be perpendicular to this longitudinal direction.

In some embodiments, the mobile element can be capable of pivoting relative to the suspension device about at least one first axis of rotation to move from one position to the other.

In some embodiments, the first axis of rotation can be by choice parallel or perpendicular to the plane of the top plate (i.e. by choice, perpendicular or parallel to the spacing direction of the upper and lower sections).

In some embodiments, the first axis of rotation can be by choice perpendicular or parallel to the abovementioned transverse plane.

In some embodiments, the first axis of rotation can be spaced away from the upper section, especially according to the spacing direction of the upper and lower sections.

In some embodiments, the first axis of rotation can be solid with the lower section.

In some embodiments, the first elastic body can be arranged between the first axis of rotation and the upper section.

In some embodiments, the first configuration can be achieved by forcing the first elastic body into a first state of elastic deformation between the first axis of rotation and the upper section.

In some embodiments, the second configuration can be achieved by forcing the first elastic body into a second state of elastic deformation between the first axis of rotation and the upper section.

In some embodiments, the mobile element can comprise a first basic body which is solid with the first axis of rotation.

In some embodiments, the first basic body can be formed in a single piece with the first axis of rotation. In this case, pivoting of the mobile element about the first axis of rotation can be effected by elasticity of the mobile element, for example by arranging the first axis of rotation and the first basic body in an articulation (especially a hinge) made in a single piece.

In some embodiments, the first basic body can be separated from the first axis of rotation and be configured to be mounted on this axis. In this case, the first basic body can comprise a section of pliers configured to connect the first axis of rotation to the first basic body by a clipping effect.

In some embodiments, the first axis of rotation can be formed in a single piece with the lower section.

In some embodiments, the first basic body can be connected to a lower section of the first elastic body.

In some embodiments, the mobile element can be fitted with at least one second elastic body which is capable of creating elastic coupling between the upper and lower sections with associated stiffness when pressure is applied to the suspension device while the mobile element occupies its first position, and which is not capable of creating said elastic coupling with said associated stiffness when the mobile element adopts the second position.

It is understood that, in the first position, the second elastic body has associated stiffness (different or equal to the first abovementioned stiffness of the first elastic body) when pressure is applied to the suspension device to create elastic coupling between the upper and lower sections with said associated stiffness.

In some embodiments, the second elastic body is solid in displacement with the first elastic body when the mobile element is brought from one position to the other. In this case, the change in configuration of the first elastic body can be taken advantage of when the mobile element is moved from one position to the other, to allow the second elastic body to be shifted by this first elastic body between two separate configurations to vary the stiffness of the suspension device in its entirety.

In some embodiments, the mobile element can be configured so that in the first position the second elastic body creates elastic coupling between the upper section and the first axis of rotation with the associated stiffness when pressure is applied to the suspension device.

In some embodiments, the first basic body can be capable of cooperating with the second elastic body to create elastic coupling between the upper section and the first axis of rotation with the associated stiffness when pressure is applied to the suspension device while the mobile element occupies its first position.

In some embodiments, the first basic body can be by choice rigid or can present some suppleness so as to participate actively in elastic coupling between the upper section and the first axis of rotation.

In some embodiments, the mobile element can be configured so that in the second position the second elastic body creates no elastic coupling between the upper and lower sections.

In some embodiments, the mobile element can be capable of pivoting relative to the suspension device about a second axis of rotation.

In some embodiments, the mobile element can be brought from one position to the other at least by rotation of the mobile element about the first and second axes of rotation.

In some embodiments, the characteristics of the suspension device relative to this second axis of rotation can be similar to those relatives to the first axis of rotation such that they will not be described further for the sake of clarity, even if their possible incorporation by the second axis of rotation forms an integral part of the present explanation.

In some embodiments, the first and second axes of rotation can be parallel to each other.

In some embodiments, the first and second axes of rotation can be spaced according to the spacing direction of the upper and lower sections.

In some embodiments, the second axis of rotation can be solid with the upper section.

In some embodiments, the mobile element can comprise a second basic body which is solid with the second axis of rotation.

In some embodiments, this second basic body can be connected to an upper section of the first elastic body.

In some embodiments, the mobile element can be formed in a single piece.

In some embodiments, the mobile element can be mounted to slide relative to the suspension device according to a direction of sliding.

In some embodiments, the mobile element can be brought from one position to the other at least by rotation of the mobile element about the first axis of rotation and by sliding of the mobile element according to the direction of sliding.

In some embodiments, the mobile element can comprise a sliding part which is solid with the upper section and capable of being translated according to the direction of sliding when the mobile element is brought from one position to the other.

In some embodiments, the suspension device can be such that the mobile element has a third position, separate from the first position and the second position, in which the first body has a third stiffness, different from the first stiffness and the second stiffness when pressure is applied to the suspension device so as to create elastic coupling between the upper and lower sections with said third stiffness.

In this way, in this third position when pressure is applied to the suspension device the first elastic body can adopt a third configuration, separate from the first configuration, capable of deforming elastically to exert retraction force with a third stiffness R3, different from the first stiffness R1 and the second stiffness R2 and creating elastic coupling between the upper and lower sections with said third stiffness R3.

In particular, three degrees of different stiffness R1, R2 and R3 can advantageously be achieved with a single first elastic body, simply by arranging this first elastic body differently relative to the suspension device, by the clearance of the displacement of the mobile element between its different positions. Therefore, the mobile element modulates the stiffness of the suspension device according to three positions, rigid, supple, and semi-supple.

In addition, this third stiffness R3 can advantageously be achieved by extension and by analogy with the means used in the embodiments detailed hereinabove to achieve the second stiffness R2.

In some embodiments, the suspension device can be such that in the second position the first elastic body creates no elastic coupling between the upper and lower sections when pressure is applied to the suspension device.

It is understood that in these embodiments the device can comprise:

an upper section fitted with a top plate capable of supporting a mattress;

a lower section comprising means for fixing the suspension device to the bed base, said lower section being connected to the upper section by suspension means;

means for modifying the stiffness of the suspension device comprising a mobile element, and the mobile element can be fitted with at least one first elastic body (for example, a first elastic body of the type previously described), and present:

a first position in which the first elastic body creates elastic coupling between the upper and lower sections when pressure is applied to the suspension device, and a second position, separate from the first position, in which the first elastic body creates no elastic coupling between the upper and lower sections when pressure is applied to the suspension device.

In particular, the suspension device can be such that in the second position when pressure is applied to the suspension device the first elastic body is not stressed.

In this way, in this second position when pressure is applied to the suspension device the first elastic body can be in a state of rest in which it does not deform elastically, such that it is not capable of exerting retraction force and creating elastic coupling between the upper and lower sections. In others terms, in the second position the first elastic body oppose a second zero stiffness R2 to displacement of the upper and lower sections relative to each other when pressure is applied to the suspension device.

Also, the suspension device can be such that in this second position the suspension means and the first elastic body are not capable of being connected in parallel when pressure is applied to the suspension device. Therefore, only the suspension stiffness Rs can oppose displacement of the upper and lower sections relative to each other when pressure is applied to the suspension device.

In some embodiments, the mobile element can have a third position, separate from the first position and the second position, in which the first elastic body presents a second stiffness, different from the first stiffness when pressure is applied to the suspension device, so as to create elastic coupling between the upper and lower sections with said second stiffness.

In this way, the mobile element modulates the stiffness of the suspension device according to three positions, rigid, supple, and semi-supple. In addition, this third position can advantageously be achieved by using characteristics similar to those previously described for the embodiments in which the second position of the mobile element allows the first elastic body to deform elastically to exhibit non-zero stiffness when pressure is applied to the suspension device.

In some embodiments, the mobile element can further comprise a second elastic body, and the suspension device can be such that in the second position the second elastic body exhibits, when pressure is applied to the suspension device, a second stiffness different from the first stiffness presented by the first elastic body in the first position, so as to create elastic coupling between the upper and lower sections with said second stiffness.

In some embodiments, this second elastic body can be separate and solid in displacement with the first elastic body.

In some embodiments, the second elastic body can exhibit stiffness different from that of the first elastic body, and in the second position the second elastic body can create elastic coupling between the upper and lower sections when pressure is applied to the suspension device.

In this way, in the second position, the elastic coupling between the upper and lower sections can be created by the second elastic body and not by the first elastic body. Therefore, in the second position the suspension means can advantageously be connected in parallel to the second elastic body on at least part of the displacement path of the upper section relative to the lower section when pressure is applied to the suspension device.

Preferably, the stiffness of the second elastic body is greater (or less) than that of the first elastic body. For this to happen, it could for example be that the second elastic body has a thickness greater (or less) than that of the first elastic body. In an alternative, materials having different degrees of stiffness could be selected.

Consequently, it is understood that in the second position the suspension device has stiffness greater (or less) than that it has when the mobile element is in the first position.

In some embodiments, the mobile element can further comprise a third elastic body, and further have a third position in which the third elastic body has when pressure is applied to the suspension device a third stiffness different from the first and second degrees of stiffness exhibited by the first and second elastic bodies respectively in the first and second positions to create elastic coupling between the upper and lower sections with said third stiffness.

In some embodiments, the mobile element can further comprise a third elastic body having a stiffness different from those of the first and second elastic bodies, and the mobile element can also have a third position in which the third elastic body creates elastic coupling between the upper and lower sections when pressure is applied to the suspension device.

In this way, in this third position the suspension means can advantageously be connected in parallel to the third elastic body on at least part of the displacement path of the upper section relative to the lower section when pressure is applied to the suspension device.

Preferably, though not exclusively, the third elastic body has a stiffness greater than that of the first and second elastic bodies. Consequently, in the third position, the suspension device has a stiffness greater than that which it has when the mobile element is in the first or in the second position.

In this way, the mobile element can modulate the stiffness of the suspension device according to three positions, rigid, supple, and semi-supple.

In some embodiments, the suspension device can be such that in the second position the mobile element creates no elastic coupling between the upper and lower sections when pressure is applied to the suspension device. This can be a "disengaged" position. The stiffness of the suspension device is therefore not modified by the mobile element. In other terms, in this second position the suspension means are disconnected from the mobile element.

In some embodiments, the mobile element can further comprise a second elastic body and also have a third position in which the second elastic body has when pressure is applied to the suspension device a second stiffness different from the first stiffness exhibited by the first elastic body in the first position to create elastic coupling between the upper and lower sections with the second stiffness.

In some embodiments, the mobile element can also comprise a second elastic body having a stiffness different from that of the first elastic body and the mobile element can also have a third position in which the second elastic body creates elastic coupling between the upper and lower sections when pressure is applied to the suspension device.

Here too, the stiffness of the second elastic body can be greater or less than that of the first elastic body so as to modulate the stiffness of the suspension device. The different degrees of stiffness could be achieved by selecting different materials or different thicknesses of the same material.

In this way, these embodiments can therefore have a disengaged position and one or two positions for which the stiffness of the suspension device is increased.

In some embodiments, the first elastic body can exhibit at least one contact part which when pressure is applied to the suspension device while the mobile element adopts its first position is capable of cooperating with said suspension device to cause elastic deformation of the first elastic body with the first stiffness, and when the mobile element is brought from one position to another said contact part can be shifted according to at least one direction parallel to the top plate.

In this way, the displacement of this contact part comprises at least one displacement component according to said at least one direction parallel to the top plate (in particular, a horizontal direction when the suspension device is fixed to the bed base in normal use conditions).

In some embodiments, the suspension device comprises a support on which said contact part is capable of being supported when pressure is applied to the suspension device.

In some embodiments, this support can be fixed (for example, formed in a single piece with) by choice to the lower section or the upper section of the suspension device.

In some embodiments, the support can be rigid or else supple. In particular, the support can take the form of an arch extending according to a longitudinal direction of the suspension device.

In some embodiments, the support can extend between the means for fixing the suspension device to the bed base, and can for example be arranged such that the apex of the arch is directed towards the upper section.

Alternatively, in some embodiments the support can project under the upper section such that the apex of the arch is directed towards the lower section.

In some embodiments, the device can comprise secondary suspension means (preferably distinct from the suspension means previously described which act as main suspension means) arranged between the support (in particular formed in the extension of the apex of the arch) and the upper section or the lower section, as a function of the embodiments executed, so as to deform elastically when pressure is applied to the suspension device.

In some embodiments, these secondary suspension means exhibit at least one fold line which is parallel by choice to the transversal direction or the longitudinal direction of the suspension device.

In some embodiments, the mobile element can be mounted to rotate relative to the suspension device such that said mobile element is brought from one position to the other by a rotation movement of the mobile element.

Such assembly produces a compact suspension device which further prevents the mobile element from being sidetracked.

In some embodiments, the mobile element can be capable of pivoting about an axis parallel to the top plate, for example an axis extending according to the longitudinal direction of the suspension device (in particular, a direction orthogonal to a plane of symmetry of the suspension device when the latter comprises such a plane of symmetry).

In some embodiments, the mobile element can present the general form of a wheel fixed to rotate on the upper section. The wheel could however be fixed rotatingly to the lower section without departing from the scope of the present invention.

Advantageously, the wheel is mounted to rotate about an axis parallel to the top plate. Preferably, the axis extends according to the longitudinal direction of the suspension device. For example, the axis of the wheel can be orthogonal to a plane of symmetry of the suspension device when the latter comprises such a plane of symmetry.

It is therefore understood that the wheel is turned to change the position of the mobile element.

In some embodiments, the wheel comprises a rim, and the elastic body or the bodies are constituted by one or more rim sections, and said rim sections are capable of resting on a support fixed to the lower section when pressure is applied to the suspension device, for example a support of the type previously described. It is therefore understood that the rim section or the sections exhibit radial elasticity to create elastic coupling between the upper and lower sections.

In some embodiments, the wheel can comprise a first rim section and a second rim section, the first rim section having a radial thickness greater than that of the second rim section, as a consequence of which the first rim section has a stiffness greater than that of the second rim section.

In some embodiments, the rim can also have an angular recess.

In a first position of the mobile element, the first rim section can be positioned between the support and the top plate, such that the first rim section creates elastic coupling between the upper and lower sections when pressure is applied to the suspension device. In this first position, the suspension device can have considerable stiffness when the suspension means and the first rim section are coupled.

In the second position of the mobile element, the recess can be positioned between the support and the top plate, such that there is no elastic coupling between the upper and lower sections when pressure is applied to the suspension device. The recess therefore creates the "disengaged" position. This is therefore the position in which the suspension device has the greatest suppleness.

In the third position of the mobile element, the second rim section can be positioned between the support and the top plate such that the second rim section creates elastic coupling between the upper and lower sections when pressure is applied to the suspension device. When the second rim section has a stiffness less than that of the first rim section it is understood that in this third position the suspension device has less stiffness than in the first position.

To improve the stability of the suspension device, the latter can further comprise two suspension elements arranged on either side of the wheel, said suspension elements elastically connecting the support to the upper section.

In some embodiments, each rim section can comprise an axial groove in which the support is housed when pressure is applied to the suspension device, which locks the mobile element in the selected position.

In some embodiments, the wheel can comprise at least one stop cooperating with the top plate and/or the support to limit the range of rotation of the mobile element.

In some embodiments, the wheel can comprise visible markings which are diametrically opposed to the rim sections forming the elastic bodies.

In some embodiments, at least one of the rim sections can comprise a groove extending according to the circumference of the wheel on either side of the axial grooves to prevent rotation of the mobile element while pressure is being applied to the suspension device.

In some embodiments, the mobile element can be capable of pivoting about an axis perpendicular to the top plate.

In some embodiments, the mobile element can be mounted to rotate about an axis perpendicular to the top plate, and the elastic body or bodies can comprise a plurality of spring blades which extend according to a direction perpendicular to the top plate, said spring blades being capable of resting on the support fixed to the lower section when pressure is applied to the suspension device.

The rotation of the wheel therefore modifies the stiffness of the suspension device by changing the position of the mobile element. The spring blades can have different degrees of stiffness. As a result, the stiffness of the suspension device can depend on the stiffness of the spring blades which rest on the support. Preferably, the spring blades have different thicknesses so as to present different degrees of stiffness.

Advantageously, the first elastic body is constituted by two spring blades, preferably wavy, which extend from the periphery of a disc fixed to a lower end of the mobile element, the two spring blades being diametrically opposed.

Preferably, the second elastic body is also constituted by two diametrically opposed spring blades, whereof the thickness is different from that of the spring blades of the first elastic body, which extend also from the periphery of the disc.

In some embodiments, the mobile element is mounted to slide according to a transversal direction of the suspension device, such that the mobile element is brought from one position to the other by a translation movement.

Advantageously, the elastic body or bodies are constituted by one or more elastic blades capable of resting on a support preferably in the form of an arch fixed to the lower section. The elastic blades exhibit different degrees of stiffness. For this to happen, they exhibit different thicknesses.

In some embodiments, the top plate can advantageously comprise an opening extending according to an orthogonal direction of the top plate, and part of the mobile element can pass through said opening so it can be actuated by an operator. In some abovementioned embodiments the wheel can project slightly through the opening such that the operator can see the markings and easily actuate the mobile element.

In some embodiments, the mobile element can comprise a actuation section and the top plate comprise an opening by means of which the actuation section projects at least partly from the top plate so it can be actuated by an operator.

In some embodiments, the mobile element can be mounted either on the lower section or on the upper section of the suspension device.

In some embodiments, the suspension means can comprise two arched walls extending between the lower section and the upper section, each of the arched walls comprising an end fixed to the lower section and another end fixed to the upper section. The mobile element is preferably arranged between the two arched walls.

In addition, the suspension device according to the invention is preferably, though not exclusively, a bed base slat end, generally designed to be fixed to a long length of bed base. For this to happen, the top plate is fitted with at least two slat housings. Preferably, the mobile element is arranged between the two slat housings.

According to a variant, the top plate has no slat housings and has one mattress support role only.

BRIEF DESCRIPTION OF THE DRAWINGS

The invention will be better understood and its advantages will emerge more clearly from the following description, of embodiments indicated by way of non-limiting examples. The description refers to the attached drawings, in which.

DETAILED DESCRIPTION OF THE INVENTION

Several embodiments of the suspension device with adjustable stiffness according to the invention will now be described. As mentioned hereinabove, the suspension device can be a slat end or a suspension system supporting a mattress. Without going beyond the scope of the present invention, the suspension device could also be mounted in a seat of a sofa or armchair.

FIGS. 1 to 5 will be used to describe a first embodiment of the suspension device according to the invention.

Figure 1:
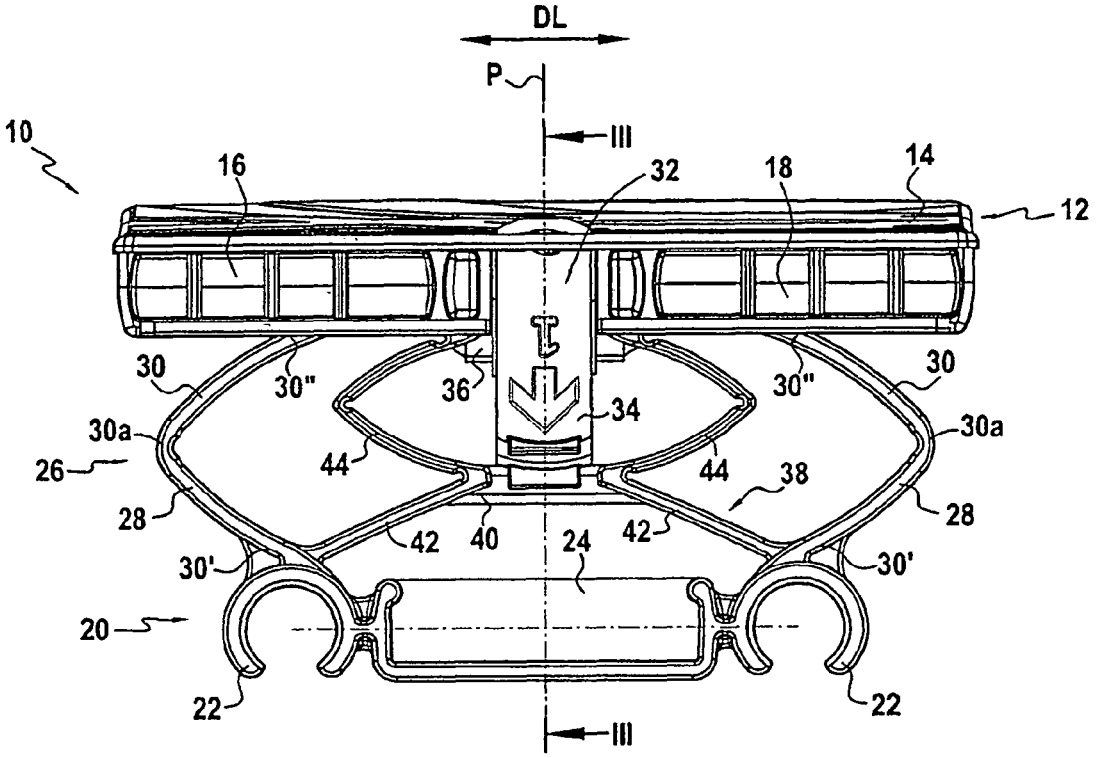
FIG. 1 is a frontal view of a first embodiment of the suspension device according to the invention in which the mobile element is a wheel mounted to rotate about an axis parallel to the top plate, and in which the top plate comprises two housings for slats.

FIG. 1 shows a suspension device 10 which is preferably made of supple plastic material of elastomer type.

This suspension device 10 has an upper section 12 fitted with a top plate 14 which comprises two housings 16, 18 for taking up the end of two slats (not shown here) according to a direction of insertion designated D. These two slats are parallel and extend in a plane, called a sleeping plane.

The top plate 14 is designed to receive a lateral section of a mattress, given that the central section of the mattress is supported by the slats.

As a result, the direction DL which is orthogonal to the plane of symmetry P of the suspension device will be called "longitudinal direction" of the suspension device, given that this plane of symmetry is parallel to the longitudinal direction of the slats and orthogonal to the top plate 14.

In addition, the direction DT which is orthogonal to the abovementioned direction DL and parallel to the direction D of insertion of the slats will be called "transversal direction" of the suspension device. The thickness of the suspension device is considered according to this transversal direction.

To be fixed to the bed base, the suspension device 10 comprises in its lower section 20 anchoring means 22 in the form of a sleeve which are designed to cooperate with tenons fixed in a long length of the bed base.

It is also evident that the suspension device 10 of this example comprises in its lower section 20 an additional housing 24 to take up a lower slat.

The upper 12 and lower 20 sections are joined together by an intermediate section 26 which comprises suspension means 28. In this example, the suspension means 28 comprise two arched supple walls 30 in the form of a "C" opening towards the interior of the suspension device and which can be folded according to fold lines 30*a* parallel to the transversal direction of the suspension device 10.

Each of these arched walls 30 has a first end 30' connected to the anchoring means 22 and a second end 30", opposite the first end 30', connected to the upper section 30".

It is therefore understood that when pressure is applied to the suspension device, especially when pressure is applied to the slats perpendicularly relative to the sleeping plane, the arched walls 30 fold according to their fold lines 30*a*, having a spring effect. The upper section 12 therefore approaches the lower section 20 when pressure is applied to the top plate of the suspension device 10.

In keeping with the invention, the suspension device 10 further comprises means 32 for modifying the stiffness of said device, said means comprising a mobile element 34. In this first embodiment, the mobile element has the general form of a wheel which is fixed to rotate on the upper section 12. More precisely, the wheel 34 is mounted to rotate about an axis 36 parallel to the top plate. To achieve this, the wheel 34 is advantageously clipped on to the axis 36.

As is evident from FIG. 1, the axis 36 extends according to the longitudinal direction DL of the suspension device 10. And also, this axis 36 is arranged below the top plate 14, between the two housings 16, 18. The wheel has a plane of symmetry which coincides substantially with the plane of symmetry P of the suspension device 10.

The wheel 34 is advantageously made of supple material, for example elastomer.

In reference again to FIG. 1, it is noted that the suspension device 10 further comprises a support 38 in the form of an arch comprising a support section 40 which is connected to the anchoring means 22 of the lower section 20 by means of supple arms 42. Preferably, this support 38 is supple.

In addition, the suspension device 10 comprises two suspension elements 44 (as secondary suspension means) arranged on either side of the wheel 34. These suspension elements, which are in the form of arched walls in the form of "C", connect the support 38 to the upper section 12. These suspension elements which improve the stability of the suspension device, are however optional. In addition, in this example these arched walls in the form of a "C" open to the interior of the suspension device and can fold according to fold lines parallel to the transversal direction.

The wheel 34 will now be described in detail by way of FIG. 3. As mentioned hereinabove, the wheel 34 is made of supple material. The wheel 34 comprises a hub 46 clipped to the axis 36, and a rim 48 connected to the hub 46 by spokes 50.

The rim 48 is composed of several rim sections, specifically a first 52 constituting a first elastic body having a first stiffness, and a second rim section 54 constituting a second elastic body having a second stiffness less than the first stiffness. Each of the two rim sections is deformable and has radial elasticity.

The second rim section 54 extends angularly between the arms 50*a* and 50*b*, while the first rim section 52 extends angularly between the arms 50*b* and 50*c*. The angular deviation between the arms 50*a* and 50*b* of the second rim section 54 is greater than that between the arms 50*b* and 50*c* of the first rim section 52, because of which the first stiffness of the first rim section is greater than the second stiffness of the second rim section. It is understood that these degrees of stiffness are considered according to a radial direction. It is also possible to augment the radial thickness of the first rim section to further augment its first stiffness.

The first and second rim sections further comprise an axial groove 52*a* and 54*a* the function of which will be explained hereinbelow.

The rim 34 further comprises a third rim section 58 which extends angularly over about 180°, as well as an angular recess 56 defined between the first rim section 52 and the third rim section 58.

Figure 2:
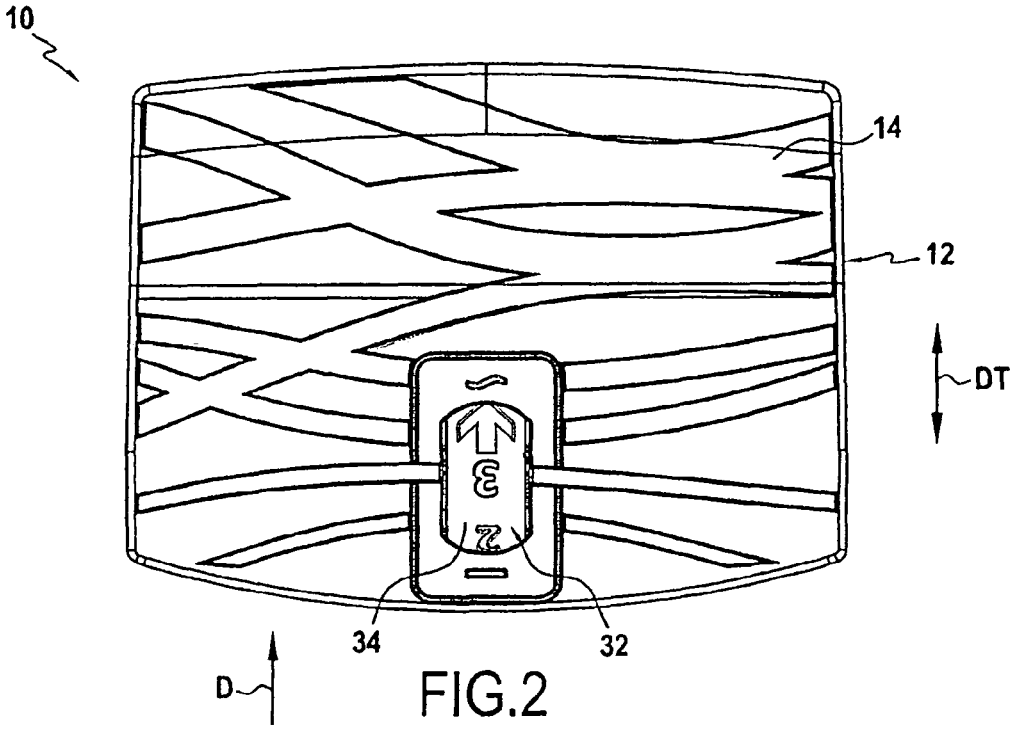
FIG. 2 is a plan view of the suspension device of FIG. 1, the mobile element being placed in its third position.
Figure 4:
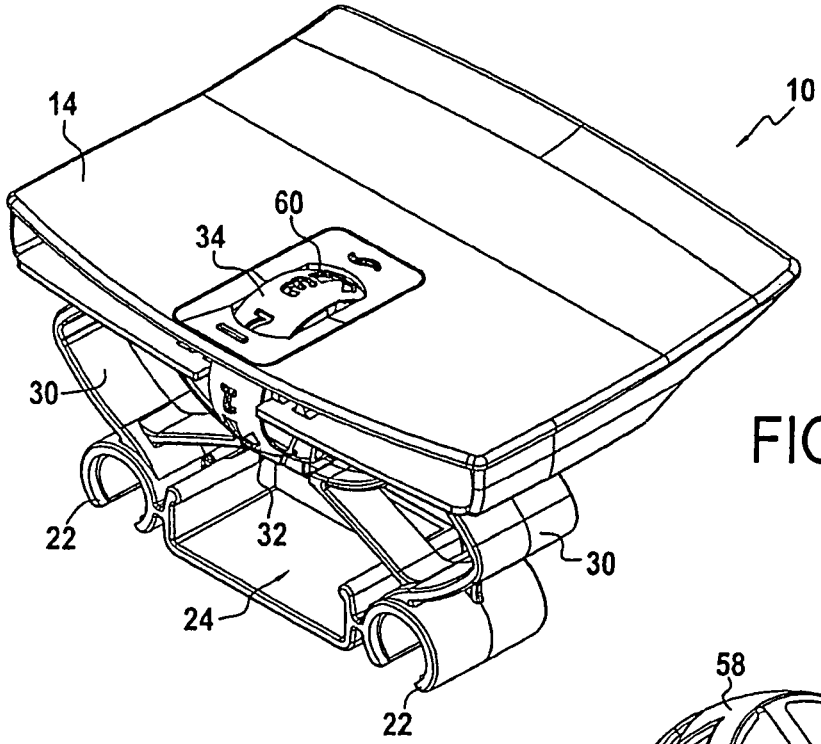
FIG. 4 is a perspective view of the suspension device of FIG. 1.
Figure 5:
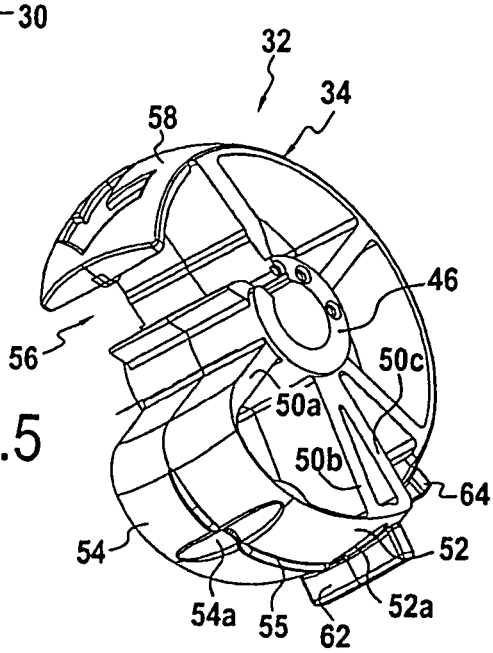
FIG. 5 is a perspective view of the mobile element of the suspension device of FIG. 1.

As is evident from FIGS. 2 and 4, the top plate 14 comprises an opening 60 which extends preferably according to a direction orthogonal to the top plate. This opening 60 extends between the two slat housings 16, 18 and terminates on either side of the upper section 12. One part of the wheel 34 passes trough the opening 60 such that an operator can easily action the wheel, that is, make it turn about the axis 36, from the upper face of the top plate.

Several markings are etched into the third rim section 58, specifically a "1" diametrically opposed to the angular recess, a "3" diametrically opposed to the first rim section 52, and a "2" diametrically opposed to the second rim section 54. Two arrows are also etched into the third rim section to indicate to the operator in which direction he should turn the wheel 34.

These markings are visible by the operator and allow him to easily adjust the stiffness of the suspension device by actuating the wheel 34.

In addition, the rim sections 52, 54 preferably comprise a groove 55 extending according to the circumference of the wheel on either side of the axial grooves to prevent rotation of the mobile element while pressure is applied to the suspension device.

The adjusting of the stiffness of the suspension device 10 will now be described in more detail.

Figure 3B:
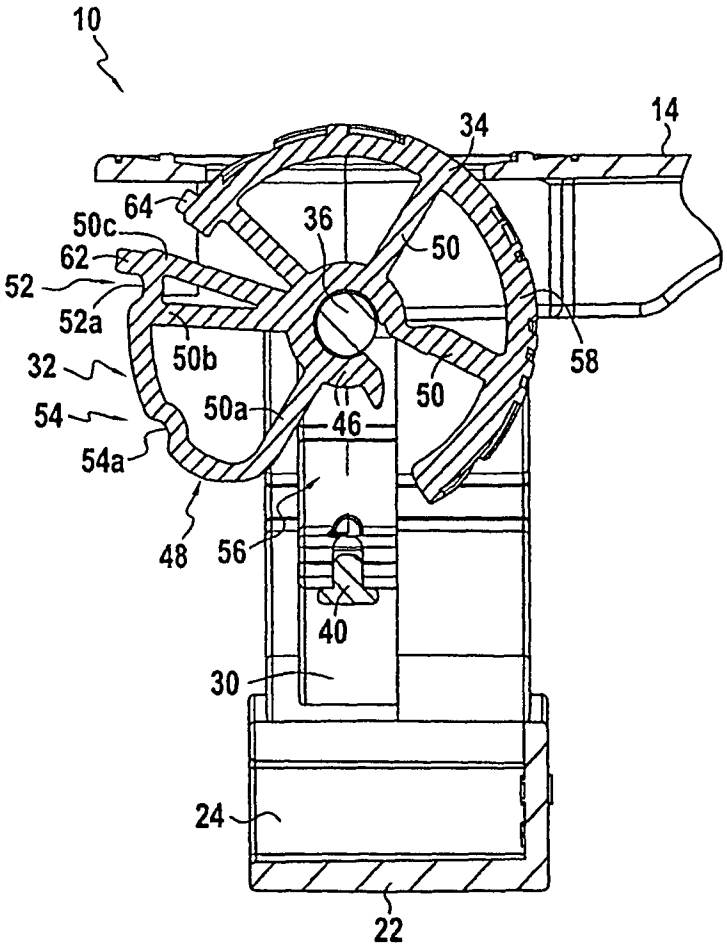
FIGS. 3A to 3C illustrate, in a side view in section, the suspension device of FIG. 1 in its three positions, FIG. 3D showing the deformation of the device when pressure is applied.
Figure 3A:
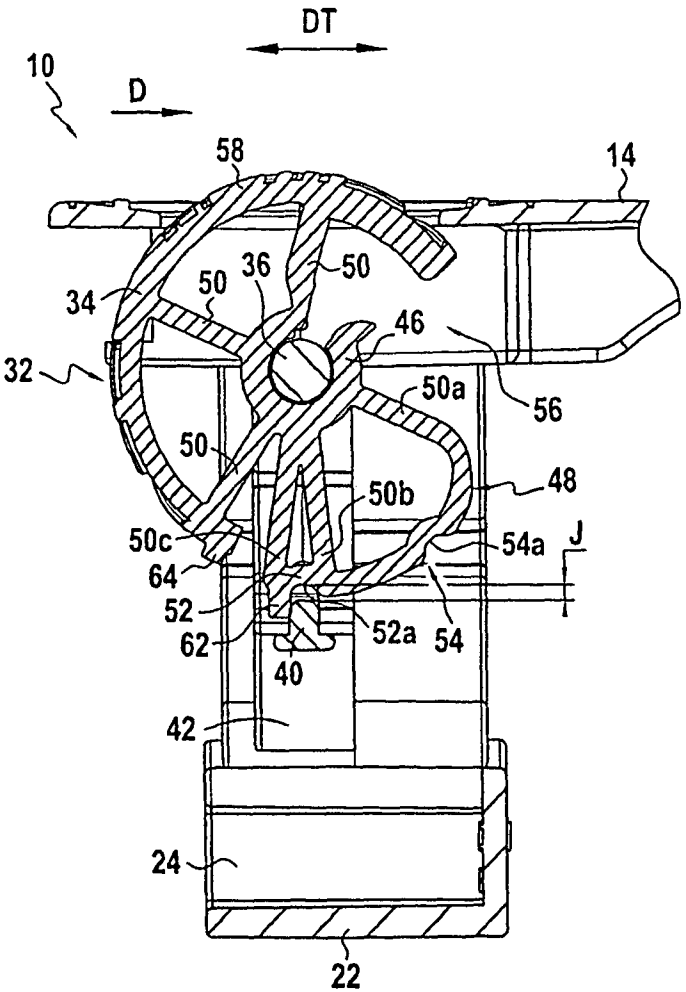

In a first position, shown in FIG. 3A, the first elastic body constituted by the first rim section 52 is arranged opposite the support section 40 such that the first elastic body creates elastic coupling between the upper 12 and lower 20 sections when pressure is applied to the suspension device. The support section 40 of the support 38 lodges in the groove 52*a* made in the first rim section 52 when pressure is applied to the suspension device 10, as a consequence of which the first elastic body 52 rests on the support section of the support 38. It eventuates that the first elastic body 52 deforms elastically while resting on the supple support 38 which deforms in turn. The first elastic body consequently acts in series with the supple support 38, the latter acting in parallel with the suspension means 30. It is also understood that cooperation between the support section 40 and the groove 52*a* prevents the mobile element 34 from changing position inopportunely.

Preferably, though not necessarily, in rest position (without pressure applied to the suspension device), a clearance J of around one millimeter is provided between the support section 40 and the first rim section 52 to facilitate handling of the mobile element.

In this way, in this first position, corresponding to the marking "3", the suspension device 10 has substantial stiffness.

In a second position, shown in FIG. 3B, the angular recess 56 is arranged opposite the support section 40. Consequently, when pressure is applied to the suspension device 10 the rim of the wheel 34 never makes contact with the support section 40. It eventuates that, in this position, corresponding to the marking "1", the mobile element does not create elastic coupling between the upper 12 and lower 20 sections. This is a disengaged position where the mobile element does not modify the intrinsic stiffness of the suspension device.

Figure 3D:
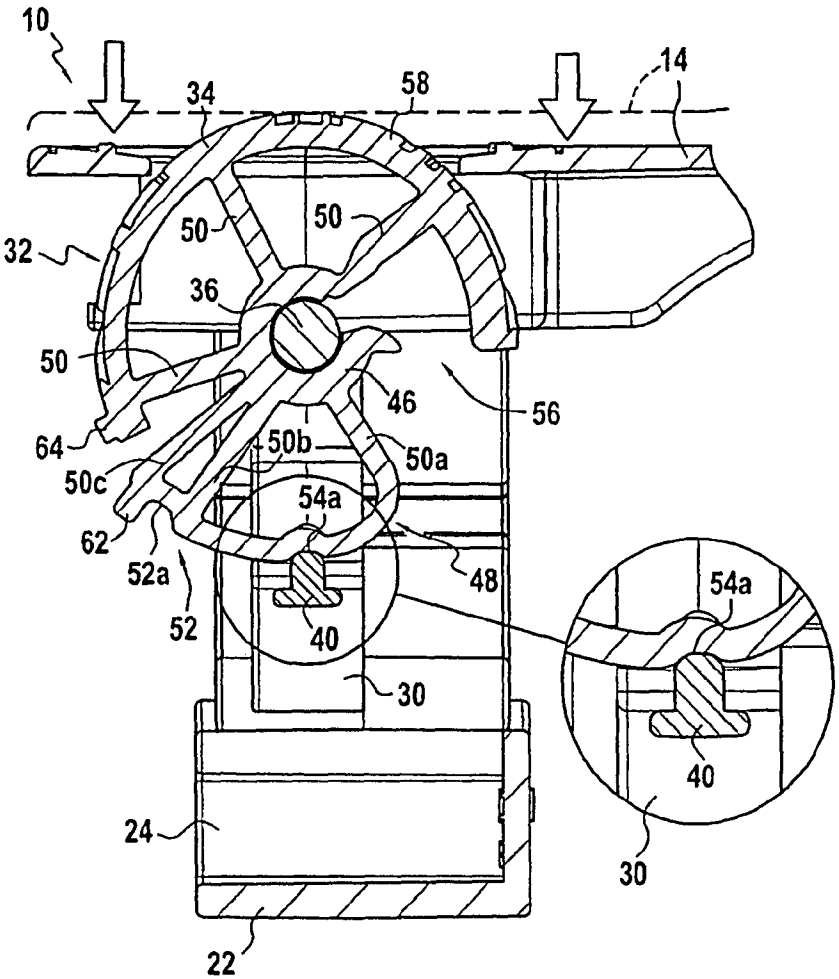
Figure 3C:
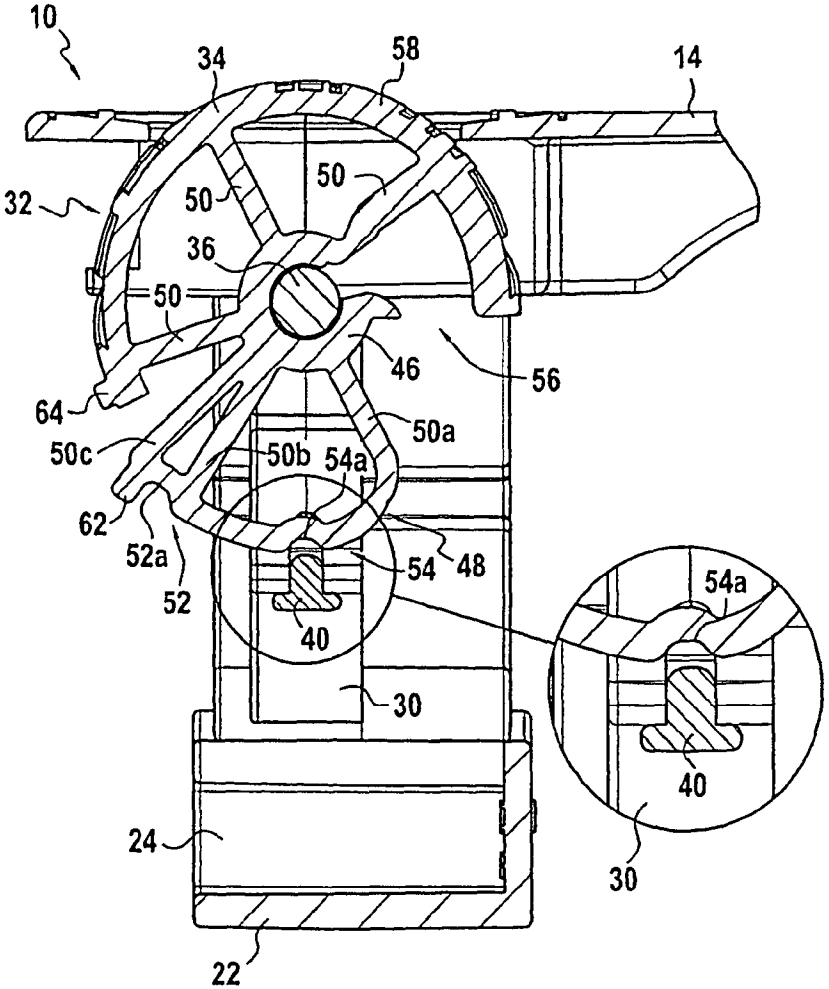

In a third position, shown in FIG. 3C, the second elastic body 54 constituted by the second rim section is arranged opposite the support section 40 such that the second elastic body 54 creates elastic coupling between the upper 12 and lower 20 sections when pressure is applied to the suspension device. The support section 40 of the support 38 lodges in the groove 54*a* made in the second rim section 54 when pressure is applied to the suspension device 10, as a consequence of which the second elastic body 54 rests on the support section of the supple support 38. It eventuates that the second elastic body 52 deforms elastically and acts in series on the supple support 38 which deforms in turn, as is shown in FIG. 3D. It is understood also that the second elastic body 42 and the supple support 38 act in parallel with the suspension means 30. Also, cooperation between the support section 40 and the groove 54*a* prevents the mobile element 34 from changing position inopportunely.

Preferably, in the rest position (without pressure applied to the suspension device), a clearance J of around one millimeter is provided here preferably, though not necessarily, between the support section 40 and the second rim section 54 to facilitate handling of the mobile element.

In this way, in this first position, corresponding to the marking "2", the suspension device 10 has average stiffness.

The mobile element 34 can assume three different positions corresponding to different degrees of stiffness to the suspension device 10.

The overall firmness of the suspension device 10 depends therefore on the local deformation capacity of the mobile element 34.

In reference to FIGS. 3A to 3D and 5, it is noted that the wheel 34 further comprises a first stop 62 arranged at one end of the first rim section 52, and a second stop 64 arranged at one end of the third rim section 58 facing the first rim section 52. The first and second stops 62, 64 restrict the range of rotation of the wheel 34 such that the third rim section 58 cannot be positioned opposite the support section 40. For this to happen, the first stop is arranged to come to a stop with the support section, as is shown in FIG. 3A, while the second stop 64 is arranged to come to a stop with the top plate 14, as is evident in FIG. 3B.

A first variant of the first embodiment described hereinabove will now be described by means of FIG. 6.

Figure 6:
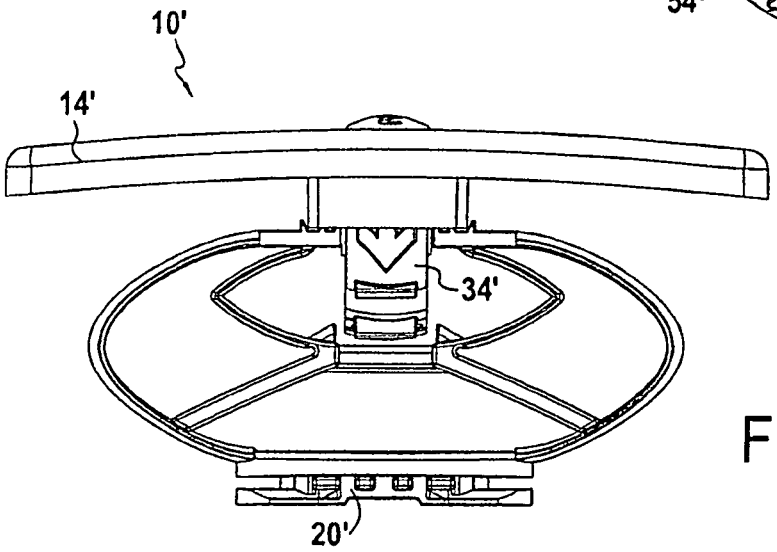
FIG. 6 is a frontal view of a first variant of the suspension device of FIG. 1, in which the top plate has no housings for slats.

This FIG. 6 shows a suspension device 10' which comprises a wheel 34' similar to the wheel 34 described hereinabove. The suspension device 10' differs from the preceding device in that the top plate 14' of the upper section 12' has no housings for slats. In addition, the lower section 20' comprises means for fastening the device to a bed base, these means comprising an installation platform.

Figure 18:
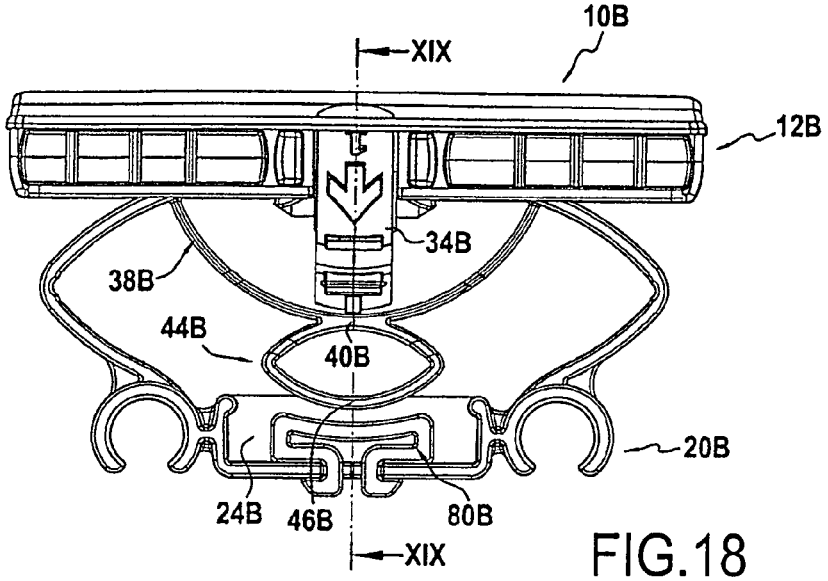
FIG. 18 is a frontal view of a second variant of the suspension device of FIG. 1.
Figure 19:
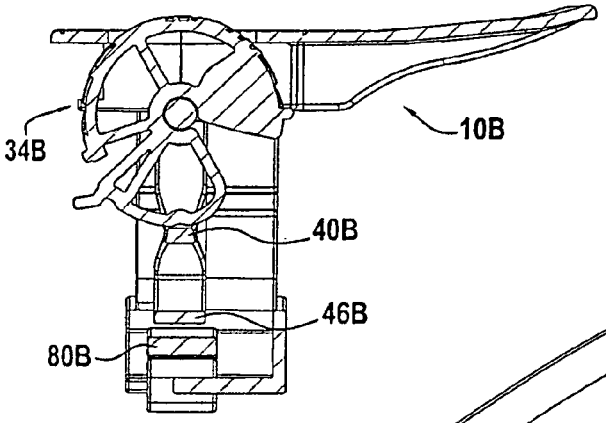
FIG. 19 is a side elevation in section of the suspension device of FIG. 18.
Figure 20:
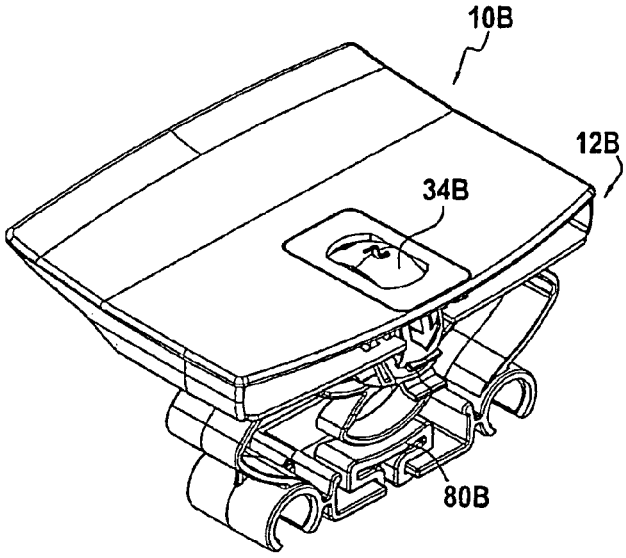
FIG. 20 is a perspective view of the suspension device of FIG. 18.

A second variant of the first embodiment described hereinabove will now be described by means of FIGS. 18 to 20.

In this second variant, the suspension device 10B differs from the suspension device 10 previously described in that the support 38B in the form of an arch comprises a support section 40B which is connected to the upper section 12B by means of supple arms. Preferably, this support 38B is supple. In this variant, the apex of the arch is pointing towards the lower section 20B.

In addition, the suspension device 10B comprises two suspension elements 44B (as secondary suspension means) arranged on either side of the wheel 34B. These suspension elements, which are in the form of arched walls in the form of "C", allow the support 38B to be supported on the lower section 20B when pressure is applied to the suspension device.

In particular, the secondary suspension means comprise a contact part 46B (which, in this example joins together the two suspension elements 44B) capable of being supported on the lower section 20B when pressure is applied to the suspension device.

In this example, this contact part 46B is capable of extending over the additional housing 24B so it can be supported on the additional lower slat, when such a slat is lodged in this housing 24B.

When no lower slat is lodged in the housing 24B, a wedge 80B, separated from the suspension device, can advantageously be mounted in the housing 24B (for example by clipping) to enable the contact part 46B to be supported on wedge 80B in the absence of the thickness of this lower slat.

To diminish noise when the contact part 46B makes contact with the wedge 80B, the latter can advantageously be made of shock-absorbing material, such as rubber or elastomer material, for example SBS.

Also, in this example, the arched walls in the form of a "C" open towards the interior of the suspension device and can fold according to fold lines parallel to the transversal direction.

Figure 21:
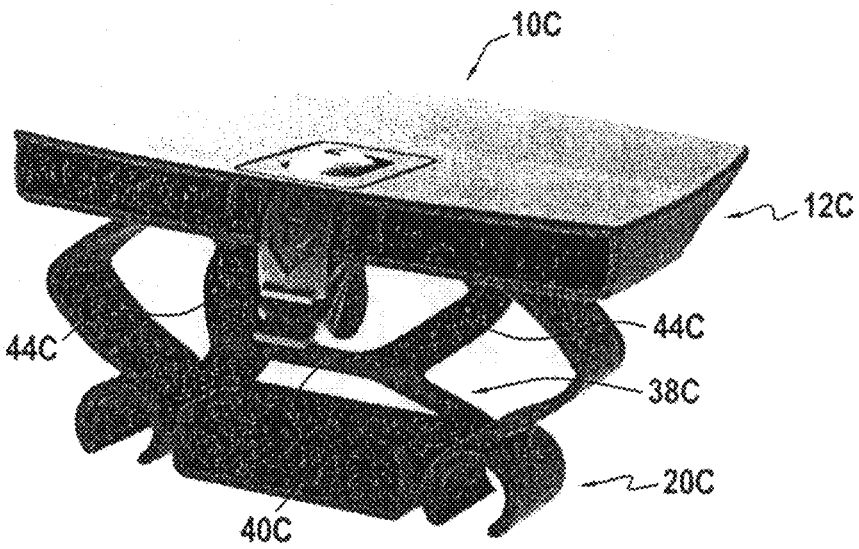
FIG. 21 is a perspective view of a third variant of the suspension device of FIG. 1.
Figure 22:
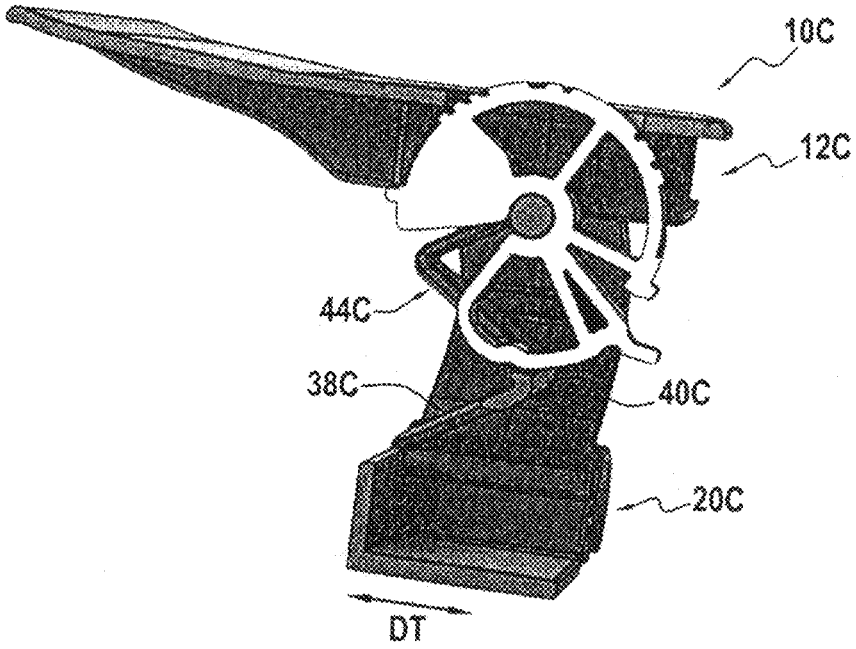
FIG. 22 is a substantially side view in section of the suspension device of FIG. 21.
Figure 23:
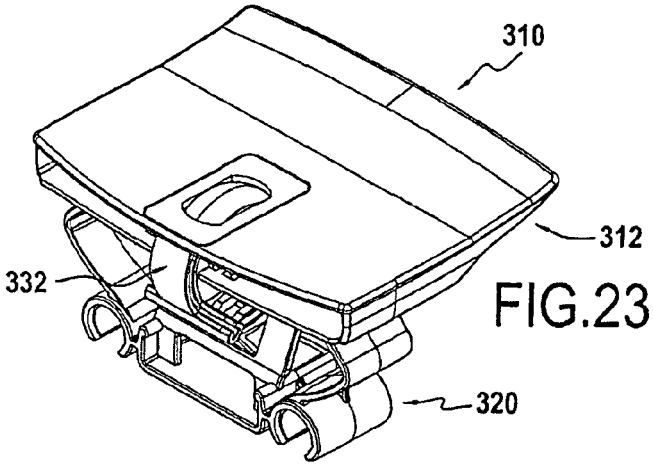
FIG. 23 is a perspective view of a fourth variant of the suspension device of FIG. 1.
Figure 24:
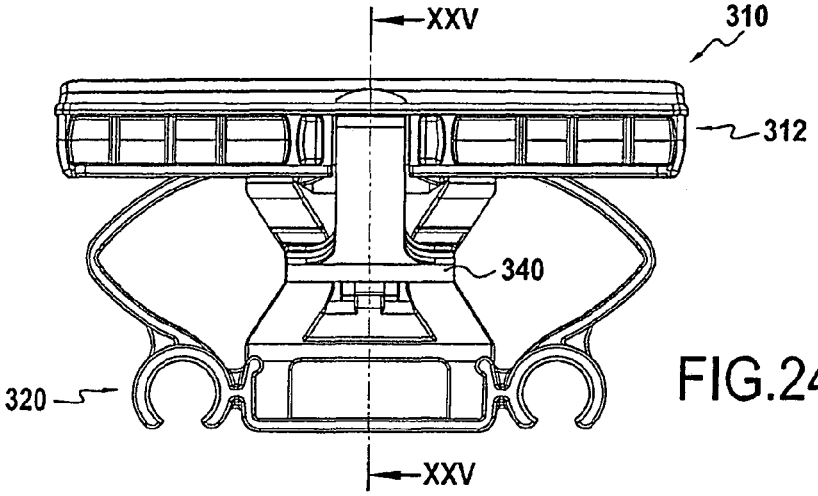
FIG. 24 is a frontal view of the suspension device of FIG. 23.

A third variant of the first embodiment described hereinabove will now be described by means of FIGS. 21 and 22.

In this third variant, the suspension device 10C differs from the suspension device 10 previously described in that the secondary suspension means exhibit at least one fold line parallel to the longitudinal direction (and therefore perpendicular to the transversal direction DT).

In particular, the suspension device 10C comprises a support 38C comprising a support section 40C which is connected to the lower section 20C by means of arms capable of folding according to fold lines parallel to the longitudinal direction.

In addition, the suspension device 10C comprises two suspension elements 44C (as secondary suspension means) arranged on either side of the wheel. These suspension elements, which are in the form of arched walls in the form of a "C", connect the support 38C to the upper section 12C. In addition, in this example, these arched walls in the form of a "C" open in the transversal direction and can fold according to fold lines parallel to the transversal direction.

A fourth variant of the first embodiment described hereinabove will now be described by means of FIGS. 23 to 25C.

In this fourth variant, the suspension device 310 differs from the suspension device 10 previously described in that the mobile element 332 is structured differently.

In particular, according to this variant, the mobile element 332 comprises a basic body 334 mounted mobile on the suspension device.

In this example, this basic body 334 is in the form of a section of a wheel, especially of a wheel substantially similar to that previously described for the suspension device 10.

This basic body 334 is mounted pivoting about an axis 336 parallel to the top plate, as previously described for the suspension device 10.

Also, in this example, the mobile element 332 further comprises an elastic tab 338, as first elastic body, which has a first end 338A by which this tab 338 is attached to said basic body 334, and a second end 338B which is free to move away from and approach the basic body 334 by flexion of the first end 338A and which is configured to cooperate with the suspension device such that the tab 338 creates elastic coupling between the upper 312 and lower 320 sections when pressure is applied to the suspension device.

More particularly, in this example when the mobile element 332 is shifted between two particular positions, the position of the first end 338A of the tab 338 is shifted so as to vary the tab flexion capacity relative to the basic body 334 and, therefore, vary the stiffness of the retraction force opposed by the tab to bringing the upper section 312 closer relative to the lower section 320 when pressure is applied to the suspension device.

Especially, in this example, the second end 338B of the tab 338 is capable of being supported on a support section 340 of the suspension device. For example, this support section 340 can be connected to the lower section 320 by means of supple arms, in particular similar to that described for the third variant described hereinabove.

More particularly, in this example, the second end 338B is capable of cooperating with the suspension device (in particular with the support section 340) at two points separate from each other, as a function of the position occupied by the mobile element 332. It eventuates that the displacement capacity of elastic tab 338 varies when the mobile element 332 is shifted, for example between the two positions illustrated in FIGS. 25B and 25C.

In particular, the displacement capacity of the tab 338, in a direction of approach (in particular the direction DV illustrated in FIGS. 25A to 25C) of the upper section 312 relative to the lower section 320, can depend on the relative positions, according to this direction of approach, of the point of flexion of the tab 338 (i.e. its first end 338A) and its free end (i.e. its second end 338B). In this way, as a function of the position occupied by the mobile element 332, these relative positions can be spaced further apart (by a distance H1 in FIG. 25B) to allow greater displacement capacity and oppose less stiffness, or on the contrary can be spaced more closely together (by a distance H2 in FIG. 25C, which is smaller than H1) to reduce the displacement capacity and oppose greater stiffness.

Figure 25A:
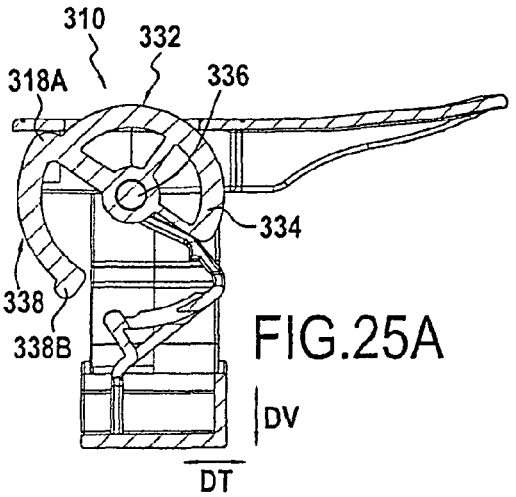
FIGS. 25A, 25B and 25C are side views in section of the suspension device of FIG. 23, showing the mobile element respectively in three positions different.
Figure 25B:
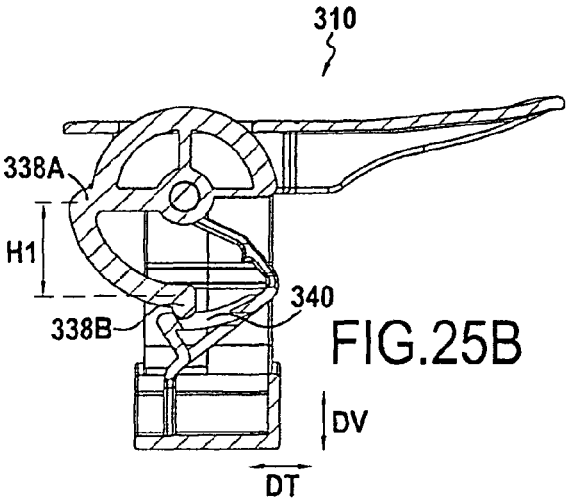
Figure 25C:
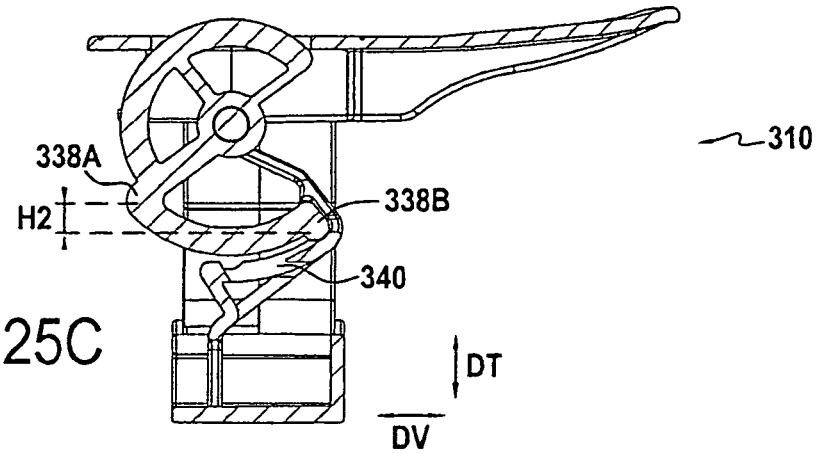
Figure 26:
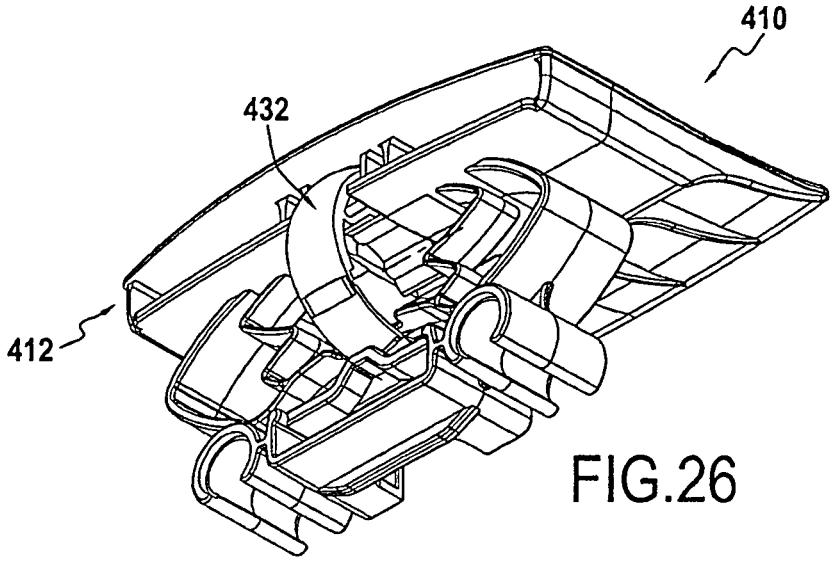
FIG. 26 is a perspective view of a fifth variant of the suspension device of FIG. 1.
Figure 27:
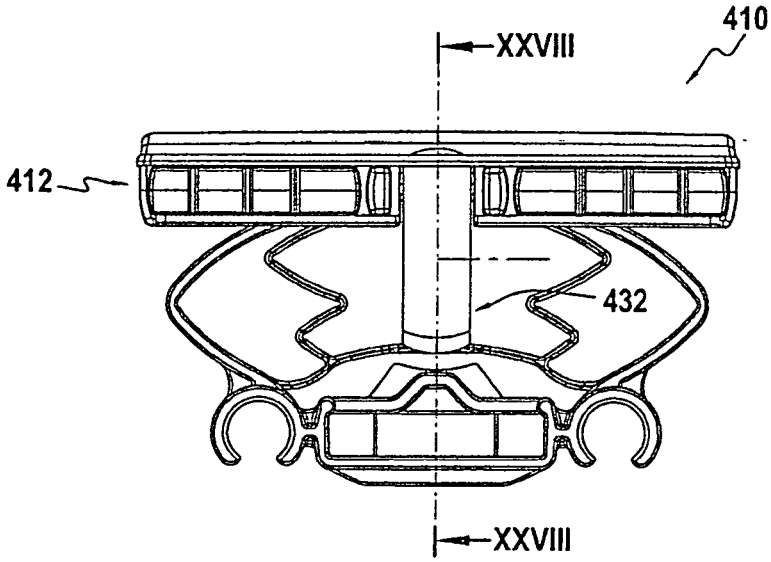
FIG. 27 is a frontal view of the suspension device of FIG. 26.

Also, as illustrated in FIG. 25A, the mobile element is also capable of occupying another position in which the elastic tab 338 creates no elastic coupling between the upper and lower sections when pressure is applied to the suspension device. In particular, the second end 338B is not capable of cooperating with the suspension device 310 such that elastic deformation of the tab 338 is not stressed when pressure is applied to the latter.

A fifth variant of the first embodiment described hereinabove will now be described by means of FIGS. 26 to 28C.

In this fifth variant, the suspension device 410 differs from the suspension device 10 previously described in that the mobile element 432 is structured differently.

In particular, according to this variant, the mobile element 432 is capable of pivoting on the suspension device 410 not by means of an axis or pivot but on the contrary by means of guide elements 420A and 420B, more discrete, having at least partially circular peripheral surfaces configured to guide the mobile element 432 in rotation.

In this example, the mobile element 432 is capable of pivoting about an imaginary geometric axis which is parallel to the longitudinal direction and which is preferably mounted on the upper section 412, with a result similar to that achieved with the suspension device 10 described hereinabove.

Figure 28A:
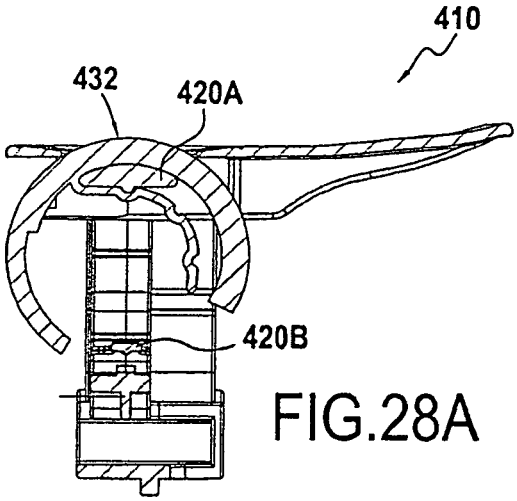
FIGS. 28A, 28B and 28C are side views in section of the suspension device of FIG. 26, showing the mobile element respectively in three positions different.
Figure 28B:
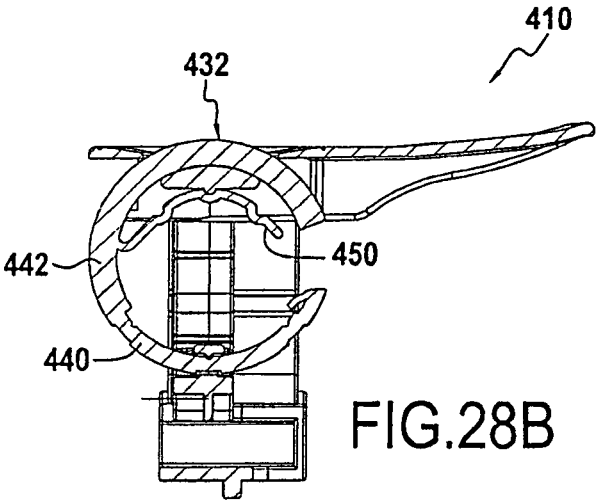
Figure 28C:
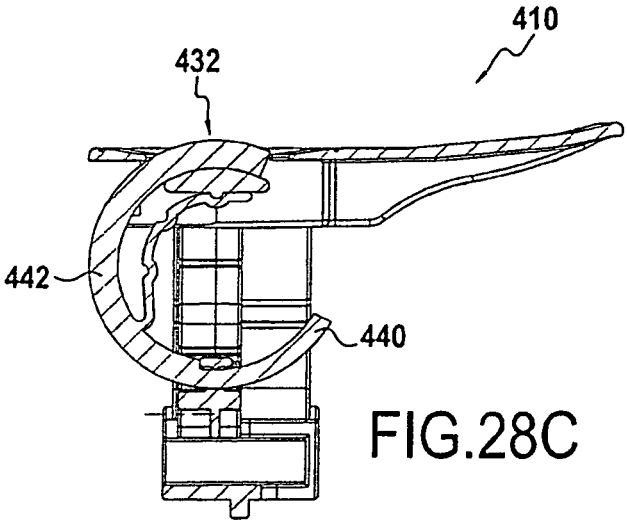
Figure 29:
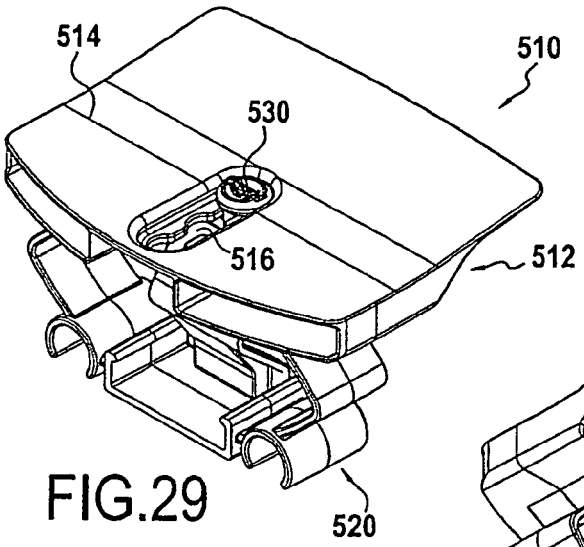
FIGS. 29 and 30 are perspective views of a fourth embodiment of a suspension device according to the present invention.
Figure 30:
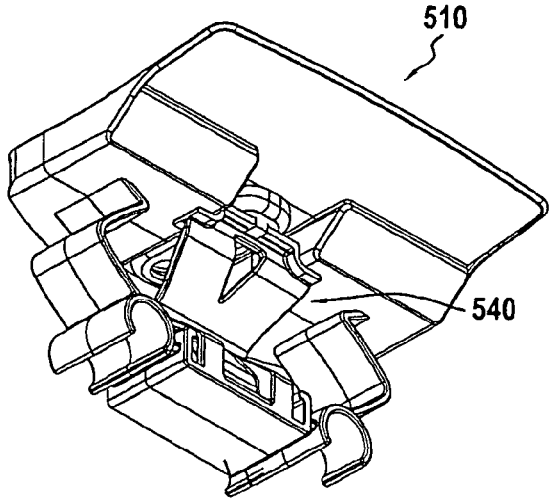
Figure 31:
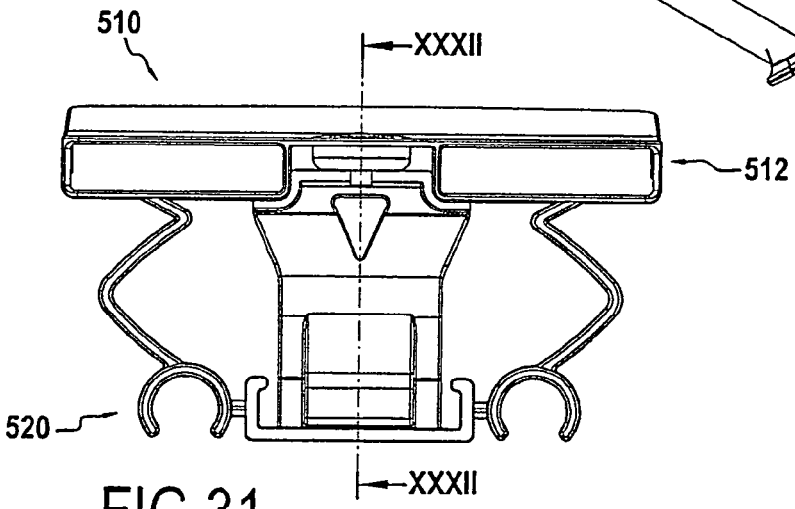
FIG. 31 is a frontal view of the suspension device of FIG. 29.
Figure 32:
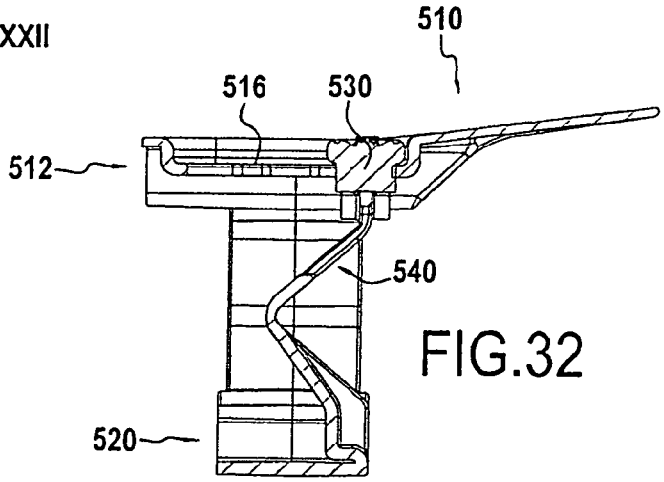
FIG. 32 is a view of a first side in elevation of the suspension device of FIG. 29.

Also, in this example, the mobile element 432 can have different arched sections 442, 440 having different thicknesses so as to embody first and second elastic bodies in terms of the present invention, which exhibit respectively distinct first and second degrees of stiffness when pressure is applied to the suspension device 410 (see in particular FIGS. 28B and 28C).

Also, as illustrated in FIG. 28A, the mobile element 432 is capable of occupying a position in which the latter creates no elastic coupling between the upper and lower sections when pressure is applied to the suspension device (see in particular FIG. 28A).

In addition, to ensure reliable connection of the mobile element 432 on the suspension device 410, on the one hand, and make it easy to move said element 432 from one position to another, on the other hand, the latter further comprises a supple blade 450 capable of cooperating with at least one section of a guide element 420A and comprising a plurality of eyelets or indices capable of cooperating with corresponding indices or eyelets of this guide element 420A.

A second embodiment of the suspension device according to the invention will now be described by means of 7 to 12.

In this second embodiment, the suspension device 110 differs from the suspension device 10 previously described in that the mobile element is mounted to rotate about an axis perpendicular to the top plate 114. The mobile element 134 is in the form of a runner having a head 170 designed to be actuated by an operator, a rod 172 connected to the head and passing through an opening 160 made in the top plate and bearing a disc 174. The upper face 174*a* of the disc, which is substantially parallel to the plane of the top plate 114, has an annular bead 176 which cooperates with guide sections 178 located on the lower surface 114*a* of the top plate 114 to allow guiding in rotation of the runner 134 relative to the upper section 112.

The disc 174 bears two pairs of spring blades, specifically a first pair comprising two diametrically opposite spring blades 180, and a second pair comprising two diametrically opposite spring blades 182. The thickness c1 of the spring blades 180 of the first pair is greater than the thickness c2 of the spring blades 182 of the second pair such that the spring blades 180 of the first pair have a stiffness greater than that of the spring blades of the second pair. It is specified that the spring blades are wavy and that they extend from the periphery of the disc 174, according to a direction perpendicular to the top plate 114, towards the lower section 120.

The spring blades 180 of the first pair constitute a first elastic body, while the spring blades 182 of the second pair constitute a second elastic body. Given the differences in thickness, the stiffness of the first elastic body 180 is greater than that of the second elastic body 182.

Figure 7:
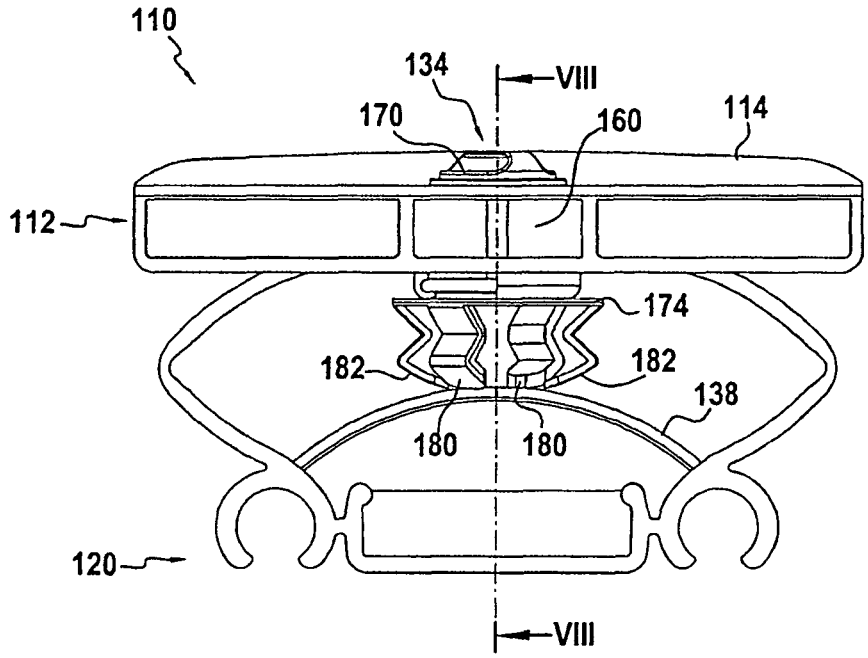
FIG. 7 is a frontal view of a second embodiment of the suspension device according to the invention in which the mobile element is mounted to rotate about an axis orthogonal to the top plate.
Figure 8:
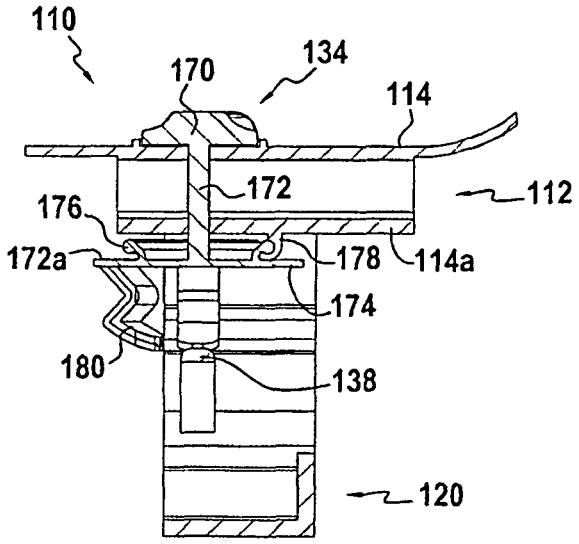
FIG. 8 is a side elevation in section of the suspension device of FIG. 7.
Figure 9:
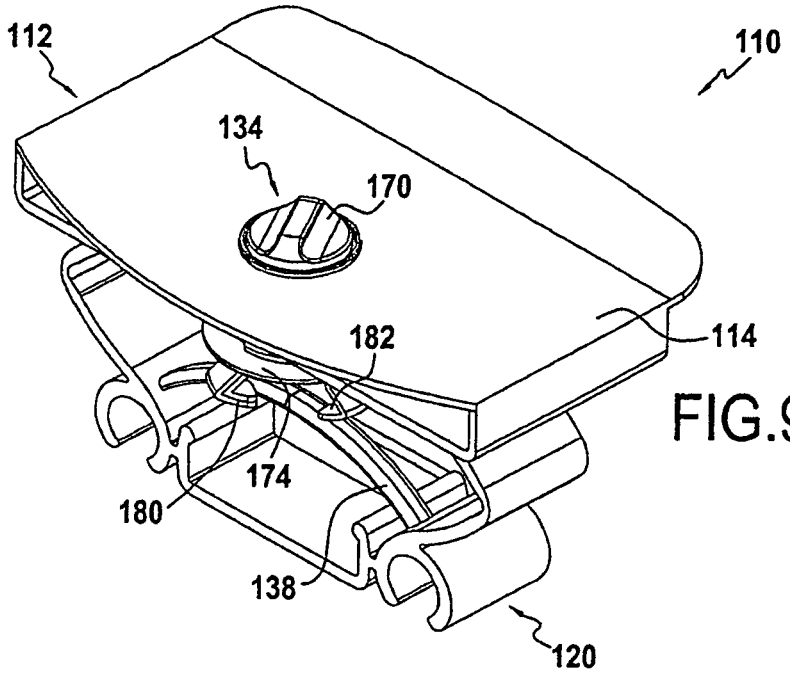
FIG. 9 is a perspective view of the suspension device of FIG. 7.
Figure 10:
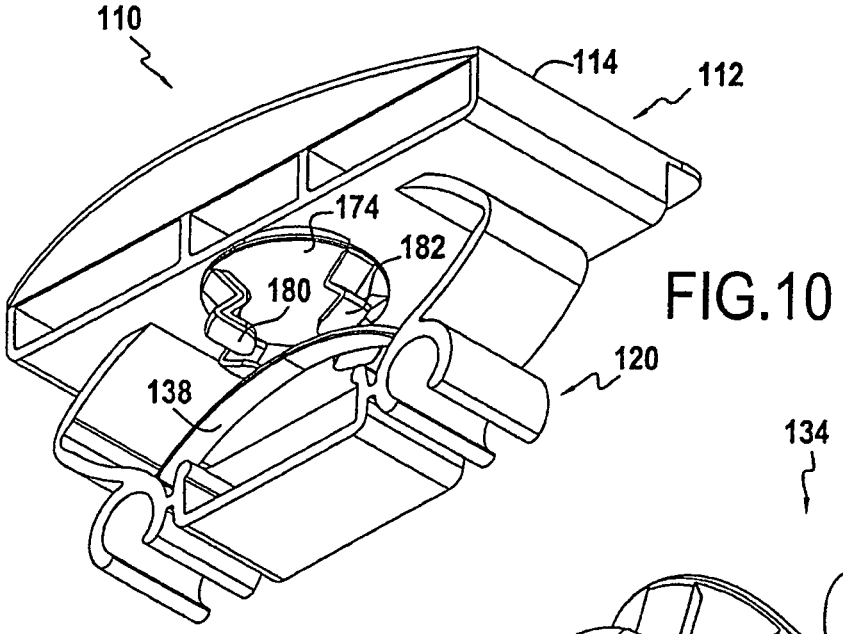
FIG. 10 is a perspective view of the suspension device of FIG. 7 showing the disc of the mobile element bearing the spring blades.

In reference to FIGS. 7 and 8, it is understood that the spring blades 180,182 are capable of making contact with the support 138 in the form of an arch, at least when pressure is applied to the suspension device.

Figure 11:
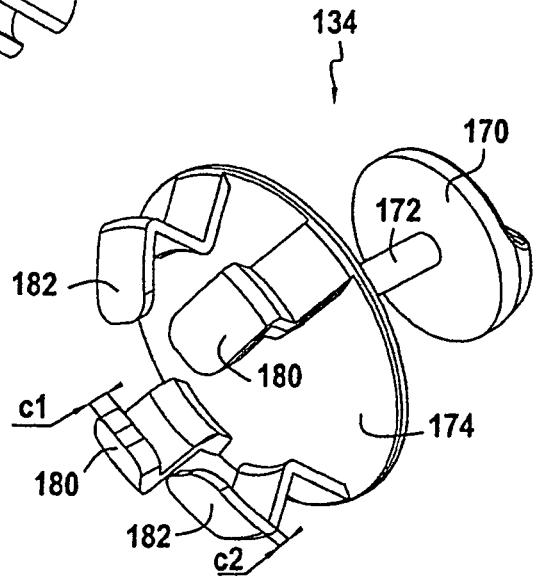
FIG. 11 is a perspective view of the mobile element of the suspension device of FIG. 7 having two elastic bodies comprising two pairs of spring blades.

In reference now to FIG. 11, which is a perspective view of the mobile element 134, it is understood that the latter has three positions.

In a first position of the mobile element 134, the first elastic body 180 (constituted by the two spring blades 180 of the first pair arranged opposite) is arranged opposite the supple support 138 in the form of an arch such that when pressure is applied to the suspension device 110 the two spring blades 180 are supported on the supple support 138 to create elastic coupling between the upper 112 and lower 120 sections. In this position, the suspension device 110 has considerable stiffness. This is the "firm" position.

In a second position of the mobile element 134, the spring blades of the two pairs 180, 182, considered according to the transversal direction DT of the suspension device 10, are positioned on either side of the supple support 138 such that when pressure is applied to the suspension device 110 none of the spring blades is supported against the supple support 138, the latter passing to the side of the support. The diametrical spacing between the spring blades 180, 182 and the transversal width of the supple support 138 will be selected to achieve this effect.

Consequently, in this second position the mobile element 134 creates no elastic coupling between the upper 112 and lower 120 sections when pressure is applied to the suspension device 110. This is the "disengaged" position.

By turning the mobile element, in this case the rotary runner 134, the operator can modify the position of the mobile element and can adjust the stiffness of the suspension device 110.

In a third position of the mobile element 134, the second elastic body 182 (constituted by the two spring blades 182 of the second pair arranged opposite) is arranged opposite the supple support 138 in the form of an arch such that when pressure is applied to the suspension device 110, the two spring blades 182 are supported on the supple support 138 to create elastic coupling between the upper 112 and lower 120 sections. In this position, the suspension device 110 has considerable stiffness. This is the "semi-supple" position.

Figure 12:
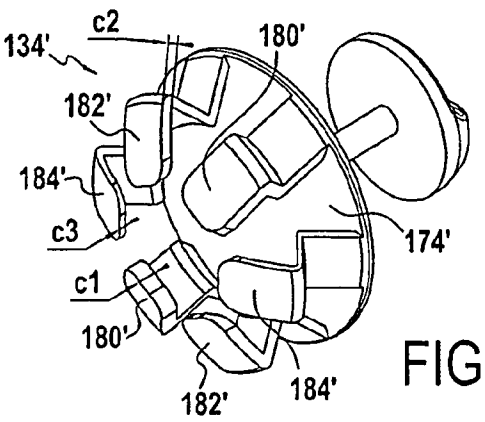
FIG. 12 is a variant of the mobile element of FIG. 11, where the mobile element has three elastic bodies comprising three pairs of spring blades.

FIG. 12 illustrates a variant of the rotary runner 134', which is distinguished from the runner of FIG. 11 in that it further comprises a third pair of spring blades 184'. These spring blades 184' extend from the periphery of the disc 174', while being diametrically opposite, and are located between the spring blades 180' and 182'. It is therefore understood that the rotary runner 134' has no disengaged position, in contrast to the rotary runner 134 previously described. In this example, the thickness of the spring blades 184' of the third pair is less than that of the spring blades 180', 182' of the first and second pairs. It could however be provided that the thickness of the spring blades 184' of the third pair is greater than the other thicknesses.

In this variant, the mobile element 134' therefore has a third position in which the spring blades 184' of the third pair, which constitute a third elastic body, are arranged opposite the supple support 138 in the form of an arch, such that when pressure is applied to the suspension device 110, the two spring blades 184' are supported on the supple support 138 to create elastic coupling between the upper 112 and lower 120 sections. In this third position, the stiffness of the suspension device is less than that of the first and second positions. This is therefore a "supple" position.

A third embodiment of the invention will now be described via FIGS. 13 to 17. As for suspension devices previously described the suspension device 210 shown in these figures comprises an upper section 212 and a lower section 220 connected to the upper section 212 by suspension means 230 having the form of arched walls 230. In this example, the upper section 212 comprises a top plate 214 and slat housings 216, 218, while the lower section 220 comprises anchoring means 222 enclosing a housing 224 for an additional slat.

The suspension device 210 further comprises a support 238 which has the form of an arch. This support 238 extends in this example in the longitudinal direction DL of the suspension device between the anchoring means 222, the apex of the arch pointing towards the upper section 212. In this example, the support 238 is supple and has elasticity according to a direction perpendicular to the top plate 214.

In this third embodiment, the mobile element 234 is mounted to slide according to the transversal direction DT of the suspension device 210. Consequently, the mobile element 234 is brought from one position to the other by a translation movement. In this example, the mobile element 234 therefore has the form of a sliding drawer which is held and guided by two guide ramps 270 fixed to the lower surface 214*a* of the top plate 214, at the end 230" of the arched walls 230. As is evident from FIG. 15, the guide ramps 270 extend according to the transversal direction DT of the suspension device 210, and the mobile element 234 has lateral wings 272 which are engaged between the guide ramps 270 and the lower surface 214*a* of the top plate 214.

Figure 17A:
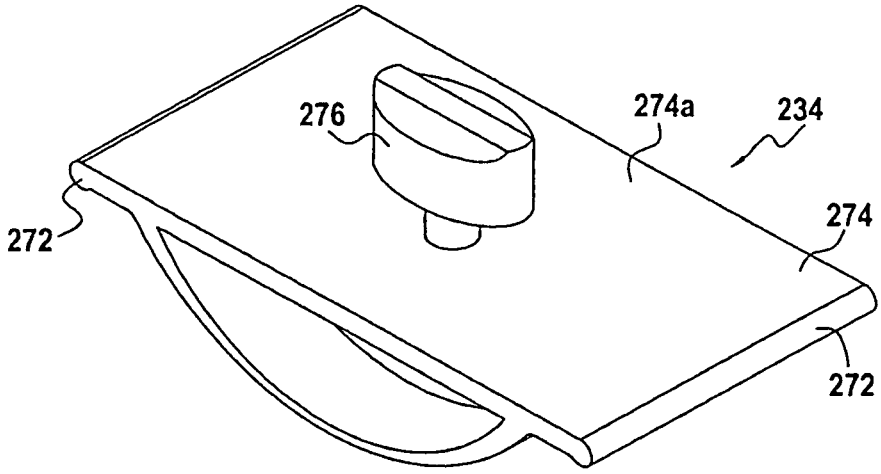
FIGS. 17A and 17B are perspective views of the mobile element of the suspension device of FIG. 13.
Figure 17B:
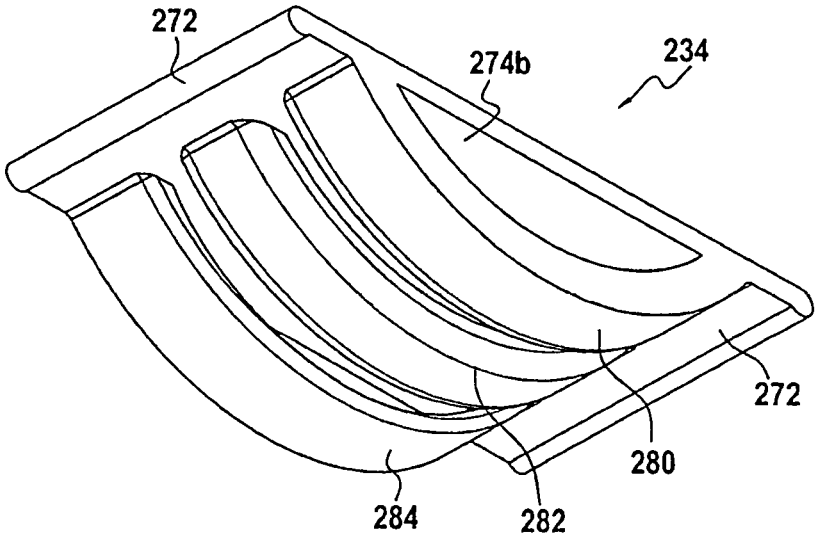

The mobile element 234A will now be described in more detail via FIGS. 17A and 17B. As is evident from these figures, the mobile element 234 is constituted by a plate 274 the lateral edges of which form the wings 272. One of the faces 274*a* of the plate bears a control finger 276 allowing the operator to move the mobile element 234 in translation according to the transversal direction of the suspension device. As is evident from FIGS. 14 and 15, the control finger 276 extends through an opening 260 formed in the top plate 214 so it can be manipulated by an operator.

The other face 274*b* of the plate 274 bears three elastic blades in the form of an arch, specifically first, second and third elastic blades designated 280, 282 and 284. In reference to FIG. 14, it is noted that the elastic blades are distinguished by their thicknesses, the thickness here being considered according to a direction perpendicular to the transversal direction to the top plate 214. In this example, the thickness e1 of the first blade elastic 280 is greater than the thickness e2 of the second blade elastic 282, which is in turn greater than the thickness e3 of the third blade elastic 284. In terms of the invention, the first, second and third elastic blades 280, 282, 284 constitute first, second and third elastic bodies which, in this example, exhibit a spring effect according to a direction orthogonal to the top plate 214. Given the differences in thickness of the three elastic blades, it is understood that the first elastic body has a stiffness greater than that of the second elastic body, the latter having a stiffness greater than that of the third elastic body.

Figure 14:
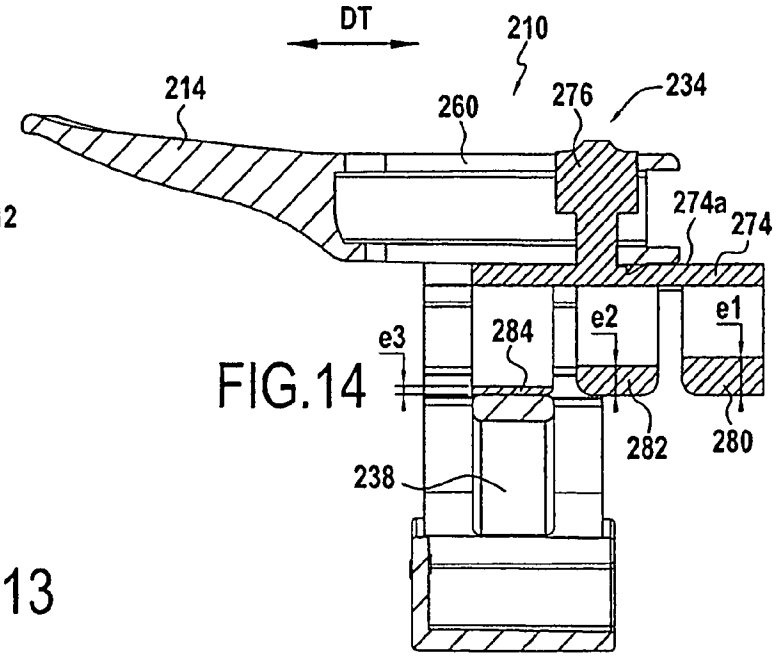
FIG. 14 is a side elevation in section of the suspension device of FIG. 13.
Figure 13:
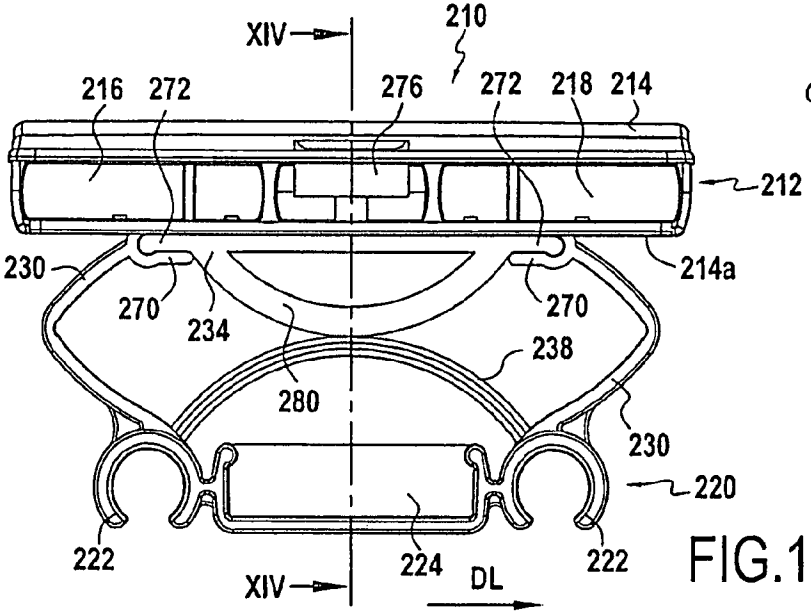
FIG. 13 is a frontal view of a third embodiment of the suspension device according to the invention in which the mobile element is a drawer sliding according to the transversal direction of the suspension device.
Figure 15:
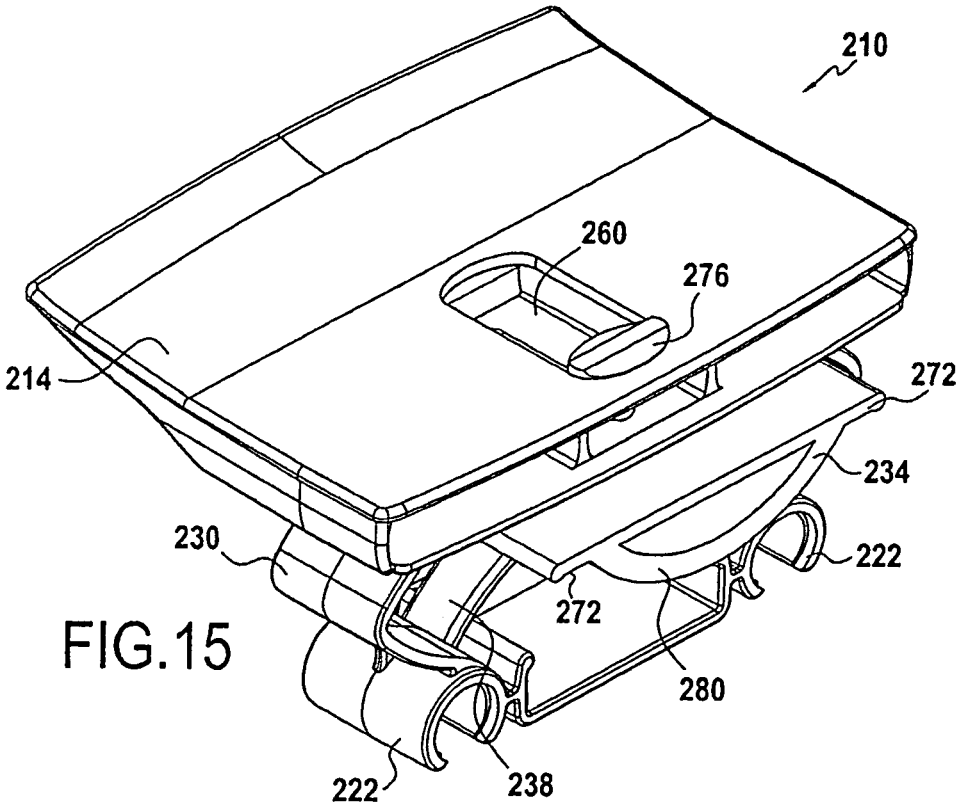
FIG. 15 is a perspective view of the suspension device of FIG. 13 showing the upper surface of the top plate and the runner of the mobile element.
Figure 16:
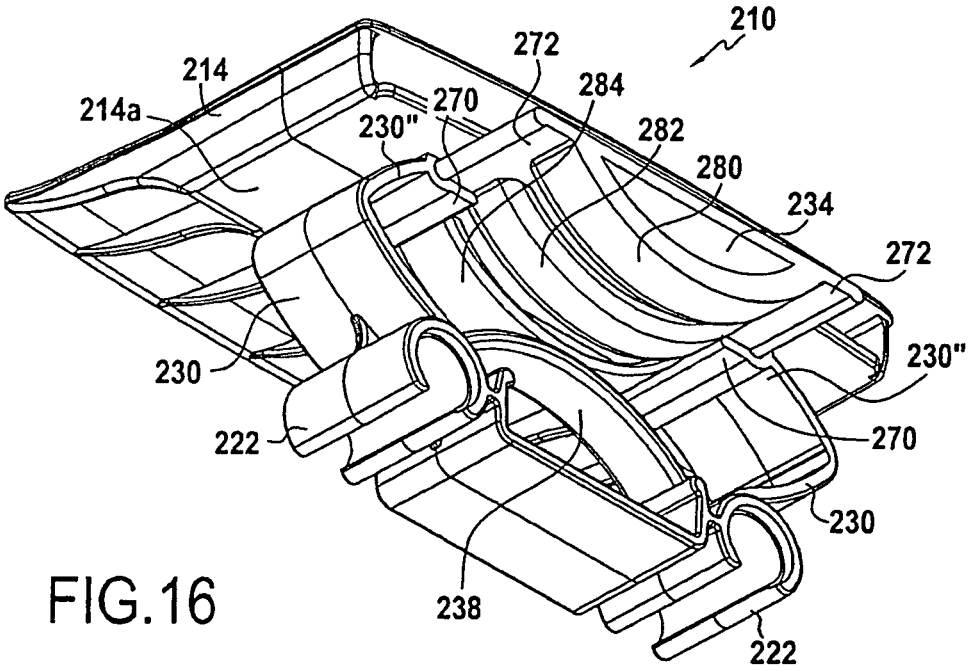
FIG. 16 is a perspective view of the suspension device of FIG. 13 showing the first, second and third elastic bodies of the mobile element.

As is understood from FIG. 14, the mobile element 234 can have three positions:

- a first position in which the first elastic body 280 is arranged opposite the support 238 such that the first elastic body 280 creates elastic coupling between the upper 212 and lower 220 sections when pressure is applied to the suspension device 210. This is the "rigid" or "firm" position;
- a second position in which the second elastic body 282 is arranged opposite the support 238 such that the second elastic body 282 creates elastic coupling between the upper 212 and lower 220 sections when pressure is applied to the suspension device 210. This is the "semi-supple" position;
- a third position in which the third elastic body 284 is arranged opposite the support 238 such that the third elastic body 284 creates elastic coupling between the upper 212 and lower 220 sections when pressure is applied to the suspension device 210. This is the "supple" position which is precisely that shown in FIG. 14.

In these three positions when pressure is applied to the suspension device, the corresponding elastic body (the elastic blade) exerts pressure on the support 238 while deforming elastically. Under the effect of this pressure, the support 238 deforms elastically in turn. Consequently, it is understood that elastic coupling is created between the upper and lower sections.

In a variant (not shown here), the mobile element comprises only two elastic blades so as to have a disengaged position where the mobile element creates no elastic coupling between the upper and lower sections when pressure is applied to the suspension device.

A fourth embodiment of the suspension device according to the invention will now be described via FIGS. 29 to 33C.

In this fourth embodiment, the suspension device 510 differs from the suspension device 10 previously described in that the mobile element is structured differently.

Figure 33A:
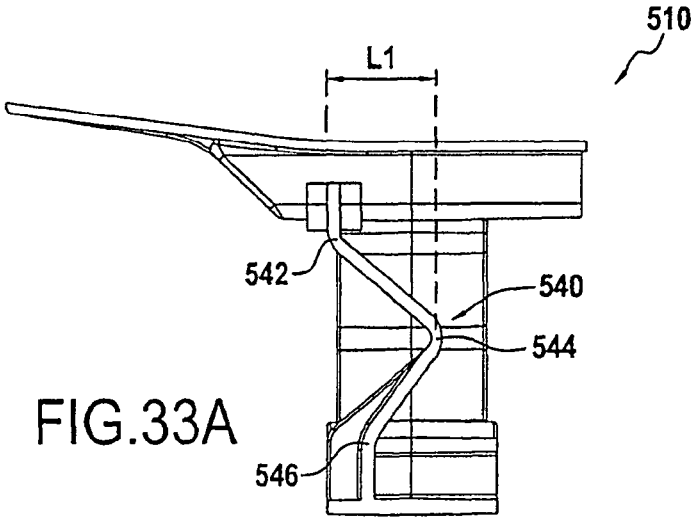
FIGS. 33A, 33B and 33C are views of the side opposite said first side of the suspension device of FIG. 29, showing the mobile element respectively in three positions different.
Figure 33B:
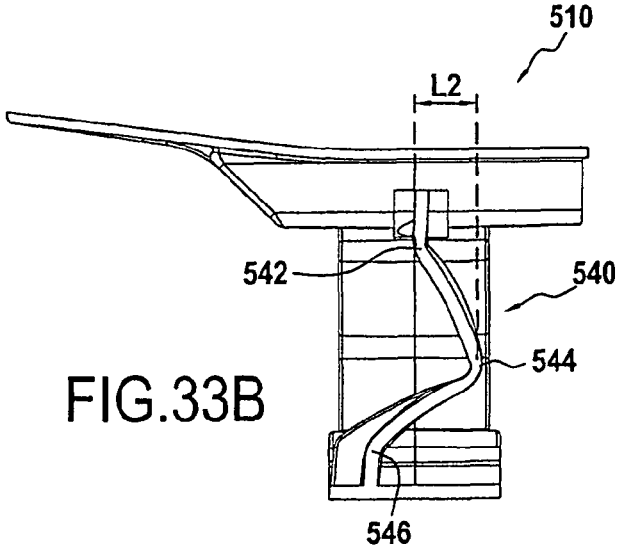
Figure 33C:
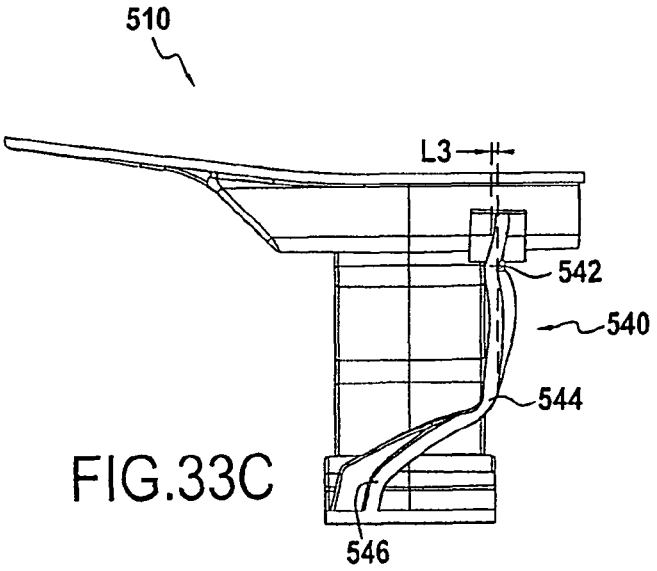
Figure 35:
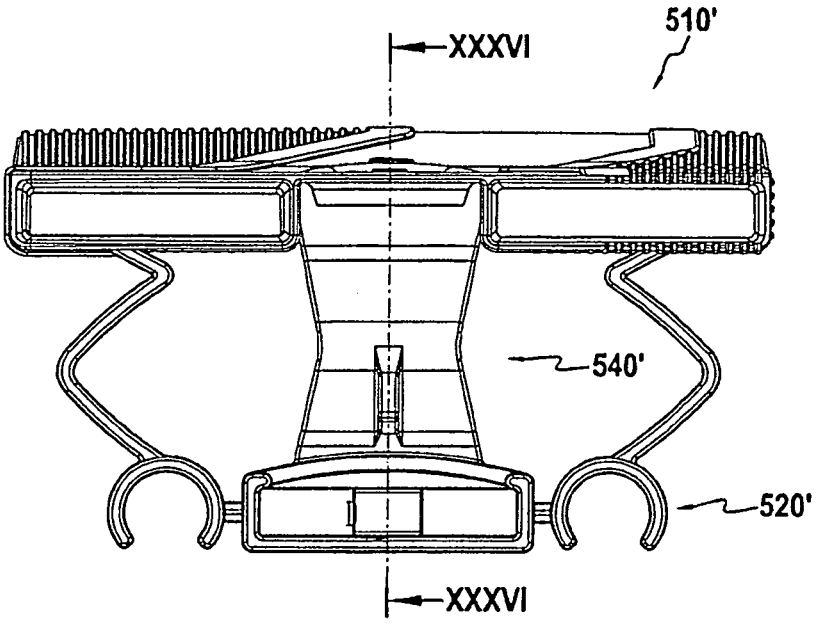
FIG. 35 is a frontal view of the suspension device of FIG. 34.
Figure 34:
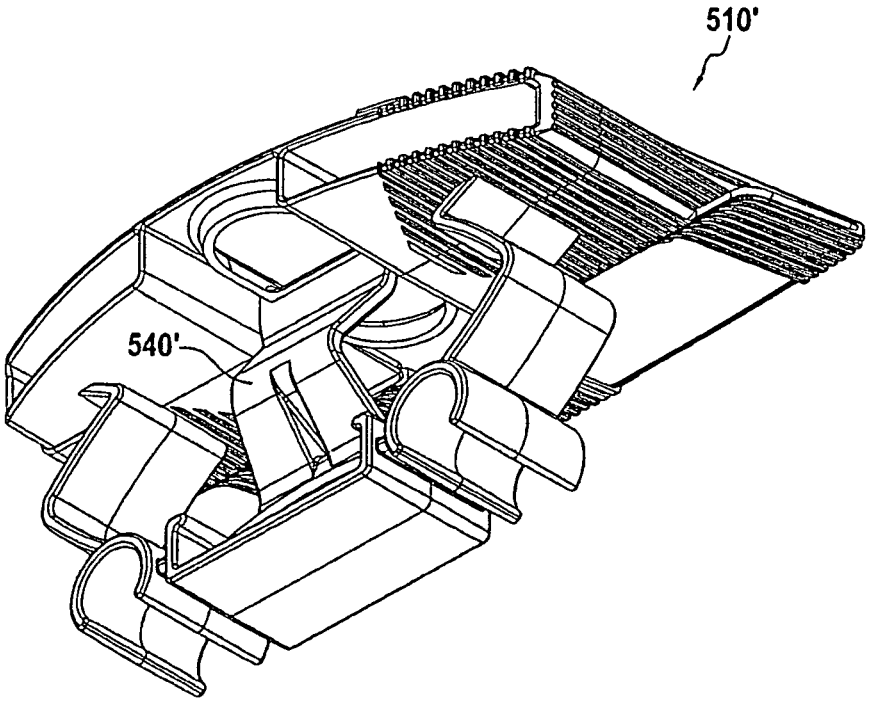
FIG. 34 is a perspective view of a first variant of the suspension device of FIG. 29.

In particular, in this embodiment the mobile element comprises a flexible blade 540, as first elastic body, capable of being arranged between the lower 520 and upper 512 sections, respectively in a first flexion configuration when the mobile element occupies a first position (more visible in FIG. 33A), in a second flexion configuration (different from the first) when the mobile element occupies a second position (more visible in FIG. 33B), and in a third flexion configuration (different from the first and different from the second) when the mobile element occupies a third position (more visible in FIG. 33C).

In particular, the flexible blade 540 is arranged between the lower 520 and upper 512 sections so as to present one or more points of flexion (in particular three points of flexion 542, 544 and 546).

The flexible blade has a first end which is fixed relative to the suspension device, in particular a first section of the lower section and the upper section (for example the lower section in this example); and a second end which is mounted movably on the suspension device such that the mobile element can be shifted between its three abovementioned positions.

In particular, this second end is capable of being shifted according to a direction perpendicular to the direction of the top plate of the suspension device, in particular according to the transversal direction of the latter. This end is terminated by handling means 530 capable of being handled to move the mobile element and capable of cooperating with a rack 516 arranged in the upper section 512 to lock the mobile element in any of the three abovementioned positions.

When the mobile element adopts its first position, the flexible blade assumes a first flexion configuration in which it presents a section easily flexible between two of its points of flexion 542 and 554, in particular because the distance L1, according to the transversal direction DT (perpendicular to the direction of rapprochement of the upper section relative to the lower section), which separates these two points is considerable. Therefore when pressure is applied to the suspension device, the flexible blade opposes resistance to elastic deformation relative to this first flexion configuration which is low. It eventuates that when pressure is applied to the suspension device, the flexible blade has a first stiffness R1 which is relatively low and creates elastic coupling between the upper and lower sections with said first stiffness R1.

When the mobile element adopts its second position, the flexible blade assumes a second flexion configuration in which it has a section less easily flexible between its points of flexion 542 and 554 than in the first position of the mobile element, in particular because the distance L2 which separates these two points is less in the second configuration than in the first. Therefore when pressure is applied to the suspension device, the flexible blade opposes resistance to elastic deformation relative to this second flexion configuration which is greater. It eventuates that when pressure is applied to the suspension device the flexible blade has a second stiffness R2 which is greater than the first stiffness R1 and creates elastic coupling between the upper and lower sections with said second stiffness R2.

When the mobile element adopts its third position, the flexible blade assumes a third flexion configuration in which it has a section even less easily flexible between its points of flexion 542 and 554 than in the second position of the mobile element, in particular because the distance L3 which separates these two points is less in the third configuration than in the second (in this example, this section of the flexible blade becomes substantially parallel to the direction of displacement of the upper section relative to the lower section, such that it becomes quasi rigid). Therefore when pressure is applied to the suspension device the flexible blade opposes resistance to elastic deformation relative to this third flexion configuration which is even greater. It eventuates that when pressure is applied to the suspension device the flexible blade has a third stiffness R3 which is greater than the second stiffness R2 and creates elastic coupling between the upper and lower sections with said third stiffness R3.

A first variant of the fourth embodiment described hereinabove will now be described via FIGS. 34 to 36C.

In this variant, the suspension device 510' differs from the suspension device 510 previously described in that the mobile element 540' is structured differently.

Figure 36A:
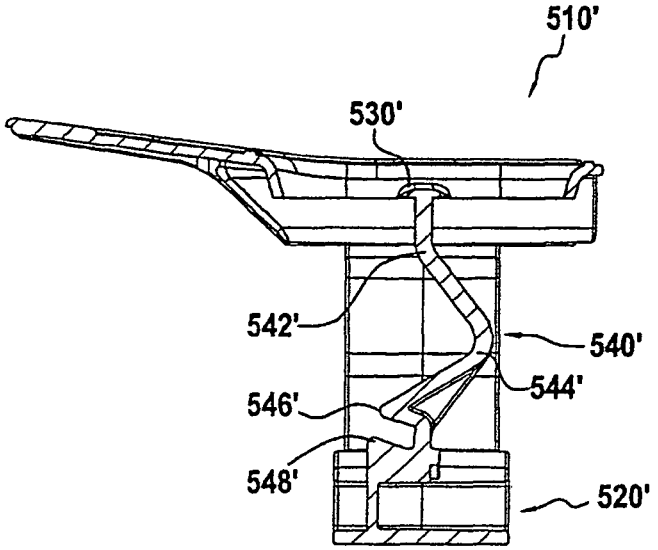
FIGS. 36A and 36B are side views in section of the suspension device of FIG. 34, showing the mobile element respectively in two different positions.
Figure 36B:
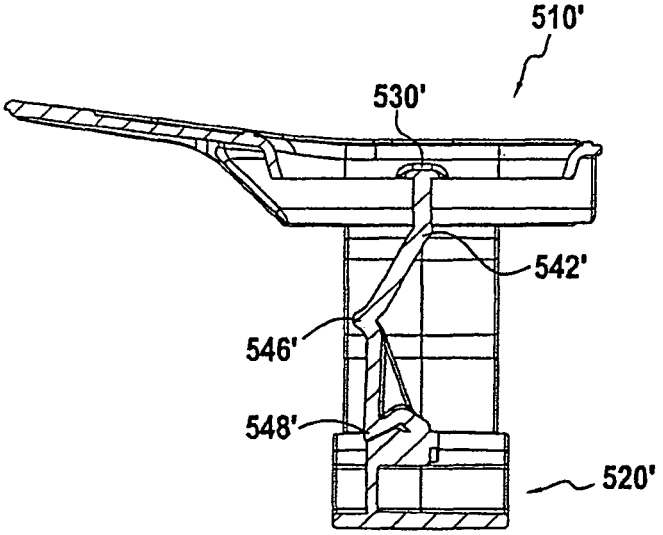
Figure 37:
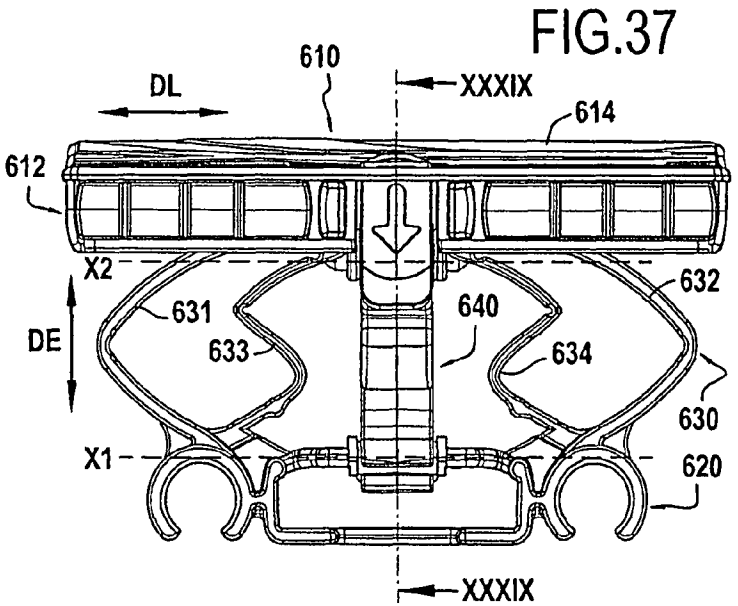
FIG. 37 is a frontal view of a second variant of the suspension device of FIG. 29.
Figure 39:
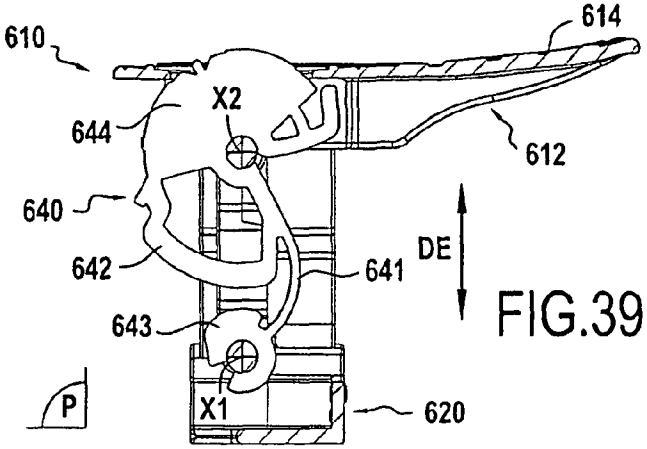
FIG. 39 is a sectional view of the device of FIG. 37.
Figure 38:
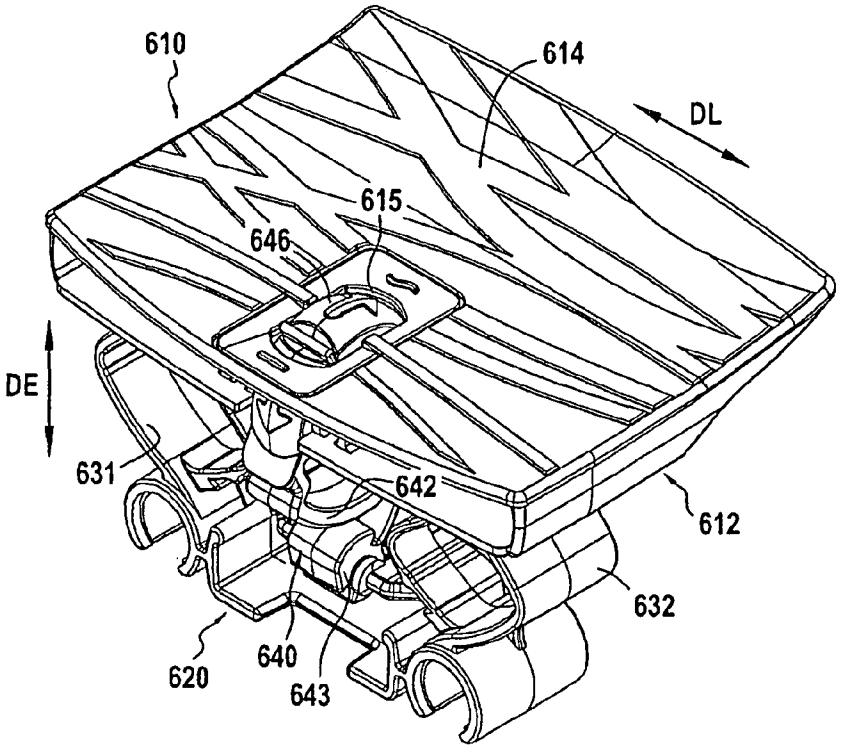
FIG. 38 is a perspective view of the device of FIG. 37.
Figure 40:
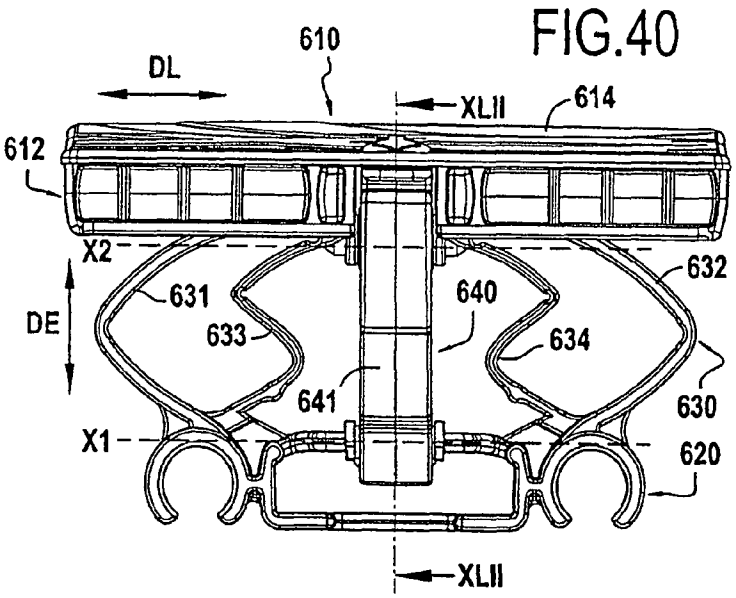
FIGS. 40 to 42 are views similar respectively to FIGS. 37 to 39, with the mobile element occupying another position.
Figure 42:
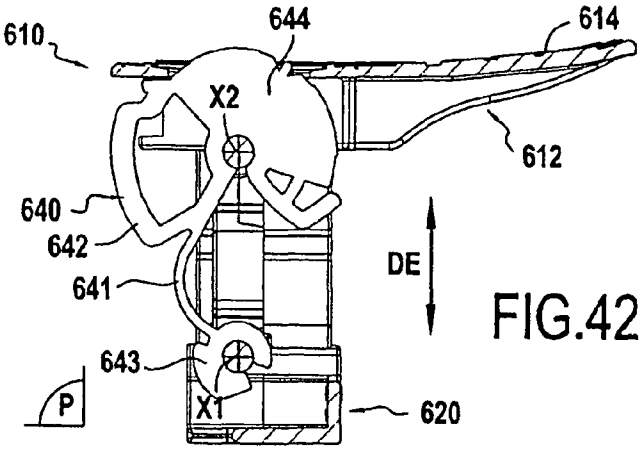
Figure 41:
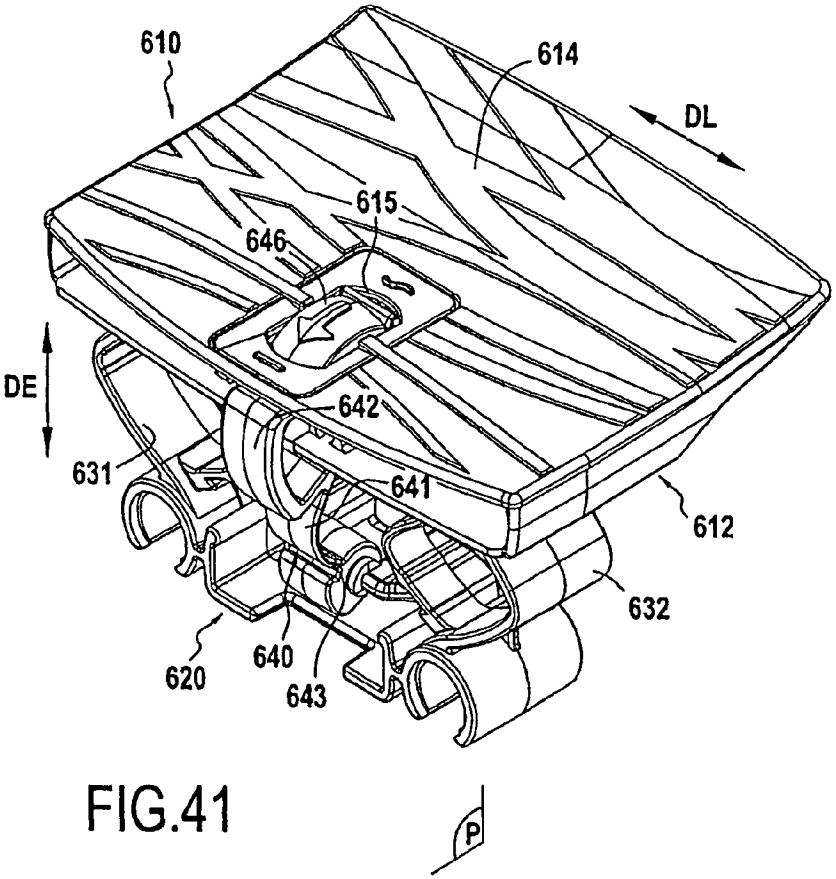

In particular, in this variant the flexible blade 540' of the mobile element 540 is capable of being arranged between the lower 520' and upper sections, respectively in only a first flexion configuration when the mobile element occupies a first position (more visible in FIG. 36A), and in a second flexion configuration (different from the first) when the mobile element occupies a second position (more visible in FIG. 36B). In this way, the mobile element is capable of occupying two positions only in this variant.

In addition, in this variant when the mobile element moves from its first position to its second position, the flexible blade 540' buckles by reversing the curvature of one of its points of flexion 544', which makes this blade less easily flexible and increases the stiffness it opposes to the displacement of the upper section relative to the lower section when pressure is applied to the suspension device.

Also, to make the blade 540' even less flexible when the mobile element adopts its second position, it is advantageous for the buckling of blade 540' to cause stopping of a section 546' of the latter with a fixed stop 548' relative to the suspension device (see FIG. 36B for more detail).

A second variant of the fourth embodiment described hereinabove will now be described via FIGS. 37 to 42.

In this variant, the suspension device 610 differs from the suspension device 510 previously described in that the mobile element 640 is structured differently.

In particular, in this example, the suspension device 610 for bed base or seat comprises:

- an upper section 612 fitted with a top plate 614 capable of supporting a mattress;
- a lower section 620 comprising means for fixing the suspension device to the bed base, said lower section being connected to the upper section by suspension means 630;
- means for modifying the stiffness of the suspension device, comprising a mobile element 640 relative to the suspension device so it can be shifted at least between a first position (visible in FIGS. 37 to 39) and a second position (visible in FIGS. 40 to 42) for modifying the stiffness of the suspension device.

In this example, the mobile element 640 is fitted with at least one first elastic body 641 which is configured to deform elastically when the mobile element is brought from one position to the other.

In this example, in the first position the first elastic body 640 is forced into a first state of elastic deformation.

In this example, in the second position, the first elastic body 640 is forced into a second state of elastic deformation.

In this example, the first elastic body 641 is configured to deform elastically by buckling when the mobile element is brought from one position to the other.

In this example, the mobile element 640 is capable of pivoting relative to the suspension device about a first axis of rotation X1 and a second axis of rotation X2 to move from one position to the other.

In this example, the first axis of rotation X1 is spaced from the upper section 612 according to the spacing direction DE of the upper 612 and lower 620 sections, and the first elastic body is arranged between the first axis of rotation X1 and the upper section 612.

In this example, the first axis of rotation X1 is solid with the lower section 620. In this way, this axis X1 is configured to move closer to then away from the upper section 614 according to the spacing direction DE when pressure is applied to the suspension device then released.

In this example, the second axis of rotation X2 is solid with the upper section 612. In this way, this axis X2 is configured to move closer to then away from the lower section 620 according to the spacing direction DE when pressure is applied to the suspension device then released.

In this example, the first and second axis X1 and X2 are spaced according to the spacing direction DE.

In this example, the first and second axis X1 and X2 are parallel to each other.

In this example, the first and second axis X1 and X2 are parallel to the top plate 614.

In this example, the first elastic body 641 is configured to deform elastically at least in a transverse plane P which is parallel to the spacing direction DE of the upper and lower sections when the mobile element 640 is brought from one position to the other.

In this example, the first and second axis X1 and X2 are perpendicular to this transverse plane P.

In this example, the device 610 comprises a plane of symmetry and is configured such that the transverse plane P is parallel to the plane of symmetry.

In this example, the device 610 is such that the suspension means 630 comprise several suspension elements 631 to 634 spaced according to a longitudinal direction DL of the device, and the transverse plane P is perpendicular to this longitudinal direction DL.

In this example, the mobile element 640 is fitted with at least one second elastic body 642 which is capable of creating elastic coupling between the upper 612 and lower 620 sections with associated stiffness when pressure is applied to the suspension device 610 while the mobile element 640 occupies its first position, and which is not capable of creating said elastic coupling with said associated stiffness when the mobile element adopts the second position.

In this example, the mobile element 640 is configured so that in the second position the second elastic body 642 creates no elastic coupling between the upper 612 and lower 620 sections.

In this example, the mobile element 640 comprises a first basic body 643 which is solid with the first axis of rotation X1.

In this example, the first basic body 643 is separated from the first axis of rotation X1 and is configured to be mounted directly on this axis. In particular, the first basic body comprises a pliers section configured to connect the first axis of rotation X1 with the first basic body 643 by clipping effect.

In this example, the first basic body 643 is formed in a single piece with a lower end of the first elastic body 641.

In this example, the mobile element comprises a second basic body 644 which is solid with the second axis of rotation X2.

In this example, this second basic body is formed in a single piece with an upper end of the first elastic body 641.

In this example, the mobile element 640 is in a single piece.

Figure 43:
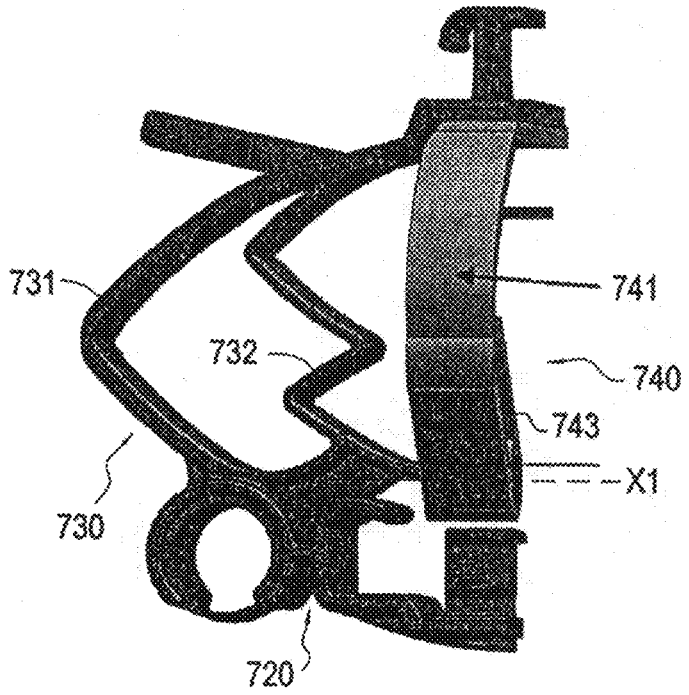
FIGS. 43 and 44 are views in partial section and in perspective of a third variant of the suspension device of FIG. 29.
Figure 44:
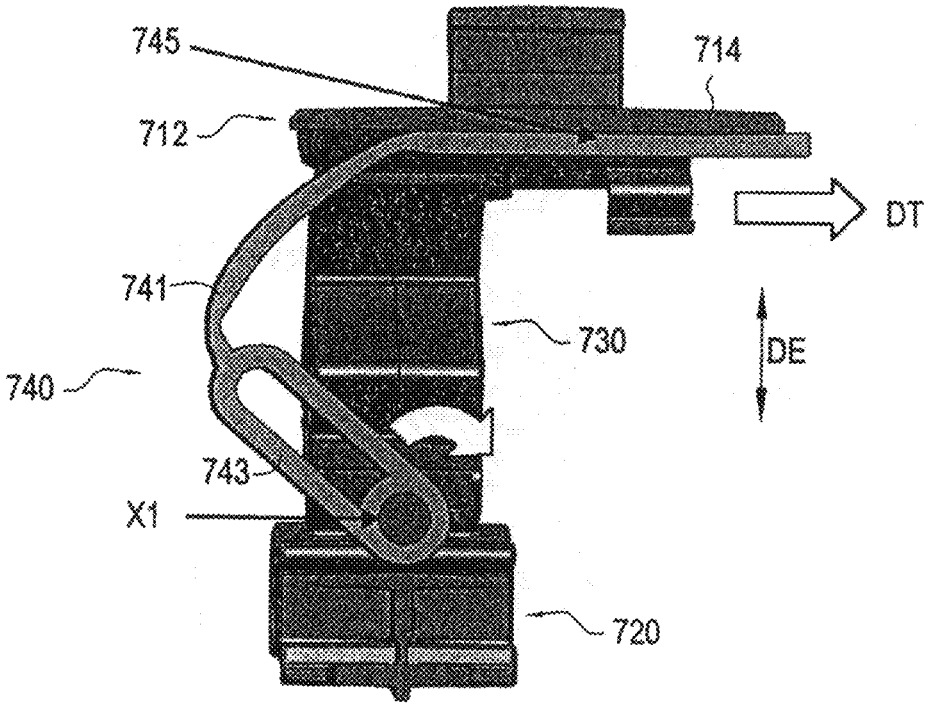

A third variant of the fourth embodiment described hereinabove will now be described via FIGS. 43 and 44.

In this variant, the suspension device 610 differs from the second variant previously described in that the mobile element 740 is structured differently.

In particular, in this example the mobile element 740 is capable of pivoting relative to the suspension device about a first axis of rotation X1 similar to that previously described and sliding relative to the device according to a direction of sliding DT to move from one position to the other.

More particularly, in this example, the mobile element 740 comprises a sliding part 745 which is solid with the upper section 712 and capable of being translated according to the direction of sliding DT when the mobile element 740 is brought from one position to the other.

In addition, in this example the same phenomenon of elastic deformation of the first elastic body 741 occurs, as previously described in association with the second variant when it moves from one position of the mobile element 740 to the other.

The modes or embodiments described in the present explanation are given by way of illustration and non-limiting, whereby for the purpose of this explanation an expert can easily modify these modes or embodiments, or consider others, and not depart from the scope of the invention.

In addition, the different characteristics of these modes or embodiments can be used alone or combined. When combined, these characteristics can be as described hereinabove or different, the invention not being limited to the specific combinations described in the present explanation. In particular, unless specified otherwise, a characteristic described in relation to a mode or embodiment can be applied similarly to another mode or embodiment.

The invention claimed is:

1. A suspension device for a bed base or a seat, comprising an upper section fitted with a top plate configured to support a mattress, a lower section adapted to be attached to a bed base, said lower section being connected to the upper section by a suspension, a mobile element, which is movable relative to the suspension device so that said mobile element can be shifted at least between a first position and a second position for modifying a stiffness of the suspension device, said mobile element being fitted with at least one first elastic body which is configured to deform elastically when the mobile element is brought from one of the first and second positions to the other.

2. The suspension device according to claim 1, wherein the mobile element is configured to pivot about at least one first axis of rotation to move from one of the first and second positions to the other.

3. The suspension device according to claim 2, wherein the mobile element is mounted to rotate about a second axis of rotation.

4. The suspension device according to claim 3, wherein the second axis of rotation is associated with the upper section.

5. The suspension device according to claim 2, wherein the first axis of rotation is spaced from the upper section according to a spacing direction between the upper and lower sections, and the first elastic body is arranged between the first axis of rotation and the upper section.

6. The suspension device according to claim 2, wherein the first axis of rotation is associated with the lower section.

7. The suspension device according to claim 1, wherein the first elastic body is configured to deform elastically at least in a transverse plane which is parallel to a spacing direction between the upper and lower sections when the mobile element is brought from one of the first and second positions to the other.

8. The suspension device according to claim 7, comprising a plane of symmetry and configured such that the transverse plane is parallel to the plane of symmetry.

9. The suspension device according to claim 7, wherein the lower section is connected to the upper section by at least two suspension elements spaced according to a longitudinal direction of the device, and the transverse plane is perpendicular to this longitudinal direction.

10. The suspension device according to claim 1, wherein the mobile element is fitted with at least one second elastic body which is configured to create elastic coupling between the upper and lower sections, said elastic coupling having an associated stiffness when pressure is applied to the suspension device, while the mobile element occupies its first position, and which is not configured to create said elastic coupling having said associated stiffness when the mobile element adopts the second position.

11. The suspension device according to claim 10, wherein the mobile element is configured so that, in the second position, the second elastic body creates no elastic coupling between the upper and lower sections.

12. The suspension device according to claim 1, wherein the mobile element is mounted to slide along a sliding direction.

13. The suspension device according to claim 12, wherein the mobile element comprises a sliding part which is associated with the upper section and capable of being translated according to the sliding direction when the mobile element is brought from one of said first and second positions to the other.

14. The suspension device according to claim 1, wherein, in the first position, the first elastic body is placed into a first state of elastic deformation.

15. The suspension device according to claim 1, wherein, in the second position, the first elastic body is placed into a second state of elastic deformation.

16. The suspension device according to claim 1, wherein the first elastic body is configured to deform elastically by buckling when the mobile element is brought from one of the first and second positions to the other.

17. The suspension device according to claim 1, wherein the suspension has a suspension stiffness which does not vary when the mobile element is brought from one of the first and second positions to the other.

18. The suspension device according to claim 1, wherein when pressure is applied to the suspension device while the mobile element adopts the first position thereof, the upper section and the lower section shift relative to each other over a predetermined displacement path, and the suspension and the first elastic body deform elastically simultaneously on at least one part of said displacement path.

* * * * *